US009316949B2

(12) United States Patent
Fujita et al.

(10) Patent No.: US 9,316,949 B2
(45) Date of Patent: Apr. 19, 2016

(54) PARTICLE ADHESION PREVENTING MEMBER, ELECTRIC FIELD FORMING MEMBER, AND IMAGE FORMING APPARATUS

(71) Applicant: CANON KABUSHIKI KAISHA, Tokyo (JP)

(72) Inventors: Hideki Fujita, Moriya (JP); Kazushige Nishiyama, Nagareyama (JP); Koki Watanabe, Moriya (JP); Eikou Mori, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/085,188

(22) Filed: Nov. 20, 2013

(65) Prior Publication Data

US 2014/0140721 A1 May 22, 2014

(30) Foreign Application Priority Data

Nov. 22, 2012 (JP) ..... 2012-256936

(51) Int. Cl.
*G03G 15/08* (2006.01)

(52) U.S. Cl.
CPC ..... *G03G 15/0898* (2013.01)

(58) Field of Classification Search
CPC ..... G03G 15/0898; G03G 15/02; G03G 15/0225; G03G 15/0258; G03G 21/06; G03G 21/08; G03G 2221/0042; G03G 2221/0063
USPC ..... 399/98, 99, 411
See application file for complete search history.

(56) References Cited

U.S. PATENT DOCUMENTS

| | | | | |
|---|---|---|---|---|
| 3,573,210 | A * | 3/1971 | Furusawa et al. | 174/110 AR |
| 2008/0019729 | A1* | 1/2008 | Hoshio et al. | 399/100 |
| 2013/0164051 | A1* | 6/2013 | Ageishi et al. | 399/313 |

FOREIGN PATENT DOCUMENTS

| | | | |
|---|---|---|---|
| JP | 5-35112 | A | 2/1993 |
| JP | 5-210290 | A | 8/1993 |
| JP | 7-209987 | A | 8/1995 |
| JP | 8-297411 | A | 11/1996 |
| JP | 11-133742 | A | 5/1999 |
| JP | 2006-239919 | A | 9/2006 |
| JP | 2007-33587 | A | 2/2007 |
| JP | 2008-3449 | A | 1/2008 |

* cited by examiner

*Primary Examiner* — Christopher Mahoney
(74) *Attorney, Agent, or Firm* — Canon USA, Inc. IP Division

(57) ABSTRACT

A particle adhesion preventing member used for an image forming apparatus that forms an image using charged toner, and configured to prevent adhesion of the charged toner, includes a conductive member, and an insulating member that is attached to the conductive member, including a porous member made of an ethylene propylene diene ternary copolymer having a density of 0.01 g/cm$^3$ or more and 0.2 g/cm$^3$ or less or silicon having a density of 0.01 g/cm$^3$ or more and 0.3 g/cm$^3$ or less, and being negatively charged with negatively charged particles adhering onto a surface thereof.

38 Claims, 27 Drawing Sheets

PARTICLE ADHESION PREVENTING MEMBER, ELECTRIC FIELD FORMING MEMBER, AND IMAGE FORMING APPARATUS

BACKGROUND OF THE INVENTION

1. Field of the Invention

The present invention relates to a particle adhesion preventing member, for example, which prevents adhesion of particles such as toner and the like that scatter in an image forming apparatus, and an image forming apparatus, such as a copying machine, a printer, a facsimile machine, and a multifunctional peripheral thereof, equipped with such a particle adhesion preventing member.

2. Description of the Related Art

Conventionally, a primary charging device, an exposure device, a developing device, a transfer device, a cleaning device, and the like are arranged at specified positions along a circumference of a photosensitive drum in an image forming apparatus to which an electrophotographic system is applied. A toner image formed on the photosensitive drum is transferred onto a recording material directly or through an intermediate transfer belt. In such an image forming apparatus, power toner is housed in a developing container in the developing device, and supplied to the photosensitive drum by rotating a developing sleeve.

At that time, the toner is scattered around due to an electric field between the developing sleeve and the photosensitive drum as well as a centrifugal force of the developing sleeve. The toner in the developing container is sometimes also blown out and scattered around from a space between the developing sleeve and the developing container due to air flow that occurs by stirring the toner in the developing container.

Also in the case of an image forming apparatus equipped with an intermediate transfer belt, mechanical rubbing is given to the toner in a primary transfer portion that is a contact portion of the photosensitive drum and the intermediate transfer belt, so that the toner sometimes scatters. This occurs similarly in a secondary transfer portion in which the toner image is transferred from the intermediate transfer belt onto the recording material. The toner image on the intermediate transfer belt sometimes also scatters by the centrifugal force with movement of the intermediate transfer belt.

The toner that has scattered in this way is typically captured by a filter provided on a ventilation fan. However, when the toner excessively scatters in the device or adheres to a particular site, it causes an image failure or maintenance of the device becomes hard. Thus, technology that prevents such scattering or adhesion of the toner has been proposed conventionally.

For example, the technology has been proposed in which for the toner that scatters from the space between the developing sleeve and the developing container, a surface opposed to the developing sleeve in the developing container is provided with an electrode, to which voltage bias with the same polarity as a charging polarity of the toner is applied (Japanese Patent Application Laid-Open No. 7-209987).

Also the technology has been proposed in which the scattering of the toner that occurs on an upper side of the developing device is prevented by arranging a plurality of electrodes in a circumference direction on a more upstream side of a rotation direction of the photosensitive drum than a position to be developed in the developing device and applying thereto alternating voltage, a phase of which is shifted (Japanese Patent Application Laid-Open No. 5-35112).

Also the technology has been proposed in which the toner is prevented from adhering onto a light-emitting surface of an LED array by providing an electrode around the LED array in the exposure device and applying the alternating voltage thereto (Japanese Patent Application Laid-Open No. 2006-239919).

The technology to aspirate the scattered toner by the use of an aspirating device and a duct has been also proposed (Japanese Patent Application Laid-Open No. 2007-33587).

The technology has been proposed in which toner contamination on the recording material is prevented by providing a recording material guiding member upstream of the secondary transfer portion with a conductive non-contact toner capture member and applying a strong bias thereto thereby capturing the scattering toner (Japanese Patent Application Laid-Open No. 2008-3449).

However, when the device for applying the voltage, the device for aspirating the toner and the duct, and the like are provided in order to prevent the scattering and adhesion of the toner as described in the aforementioned patent references, the apparatus increases in cost and size.

On the other hand in recent years, with downsizing the image forming apparatus, the technology as aforementioned to lead an increased size of the apparatus is difficult to be introduced. Also in the case of such a downsized apparatus, the space between the parts is narrow and the toner contamination occurs easily. Therefore, cleaning by a service engineer must be frequently performed and it takes a long time to clean the apparatus. Thus, a maintenance cost is increased. Particularly in the case of a high speed image forming apparatus, the toner tends to scatter more frequently and the maintenance cost is more easily increased.

SUMMARY OF THE INVENTION

The present invention is directed to a configuration in which adhesion of particles or scattering of the particles can be prevented while the apparatus is prevented from increasing in cost and size.

According to an aspect of the present invention, an image forming apparatus includes an image bearing member that moves while bearing a toner image, a developing device that includes a developer bearing member that bears charged toner and develops an electrostatic latent image formed on the image bearing member with toner, and an electric field forming member that forms an electric field between a surface thereof onto which the charged toner adheres and an opposed portion in the image forming apparatus, wherein the electric field forming member includes a conductive member provided to maintain a predetermined reference potential, and an insulating member attached to the conductive member at a position opposite the opposed portion, the insulating member including a porous member made of an ethylene propylene diene ternary copolymer having a volume resistivity of $10^{10}$ Ω·cm or more and $10^{16}$ Ω·cm or less and a density of 0.01 g/cm$^3$ or more and 0.2 g/cm$^3$ or less or silicon having a volume resistivity of $10^{10}$ Ω·cm or more and $10^{16}$ Ω·cm or less and a density of 0.01 g/cm$^3$ or more and 0.3 g/cm$^3$ or less.

Further features of the present invention will become apparent from the following description of exemplary embodiments with reference to the attached drawings.

DESCRIPTION OF THE EMBODIMENTS

Figure 1:
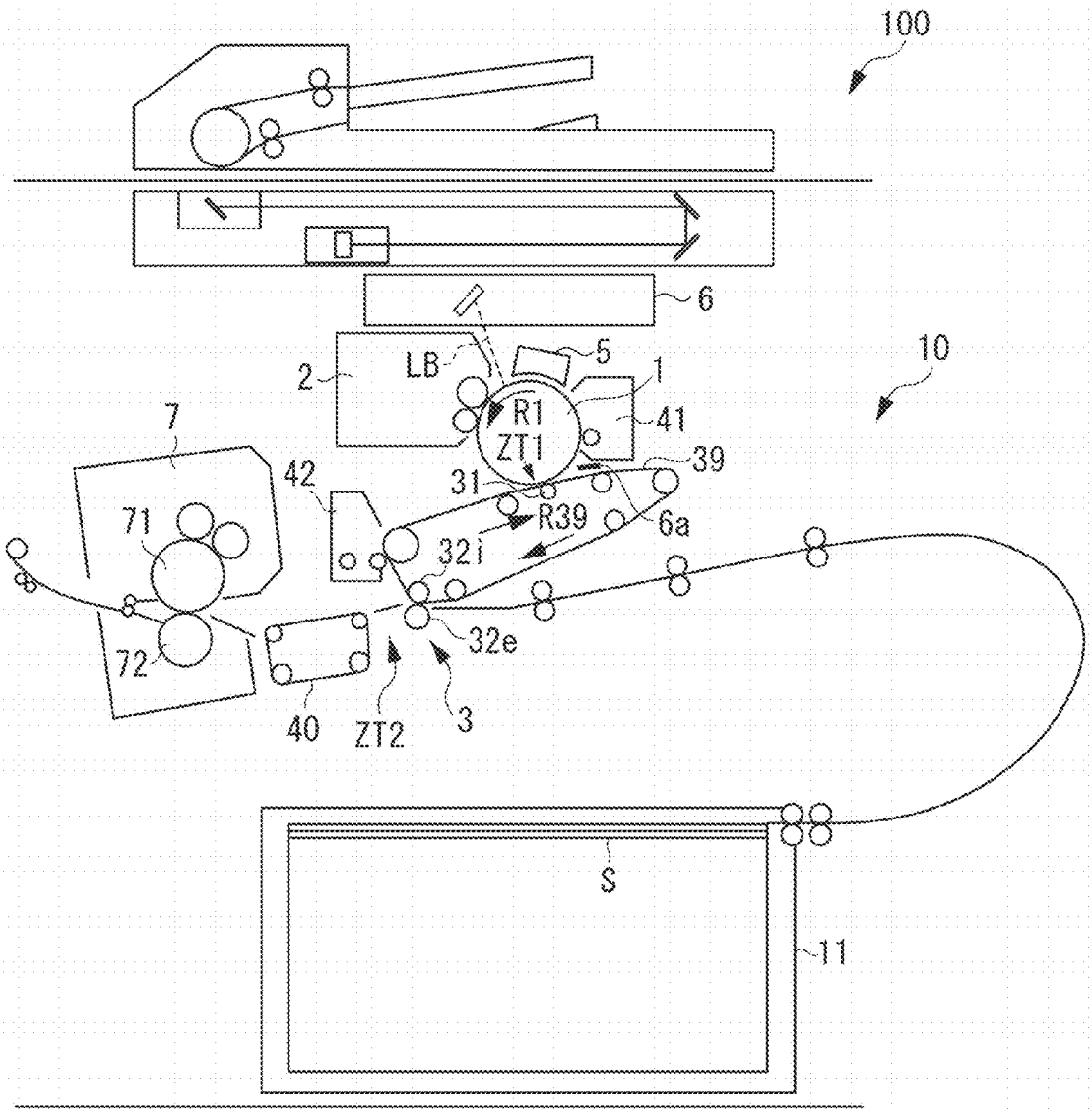
FIG. 1 is a schematic cross-sectional view of an image forming apparatus according to a first embodiment of the present invention.
Figure 2:
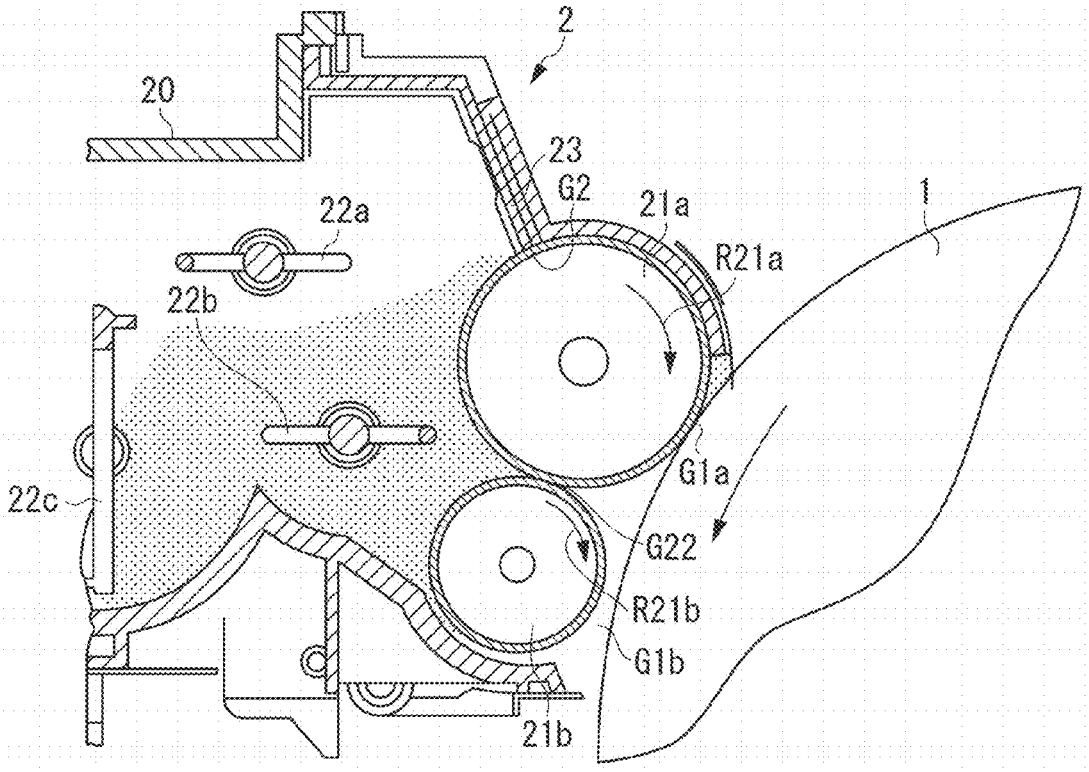
FIG. 2 is a schematic cross-sectional view of a developing device according to the first embodiment.

A first embodiment of the present invention will be described using FIG. 1 or FIG. 11. First, an outline framework of an image forming apparatus of the present embodiment will be described using FIG. 1 or FIG. 4.

[Image Forming Apparatus]

An image forming apparatus 100 of the present embodiment is a printer with an electrophotographic system and includes a photosensitive drum 1 as an image bearing member. The photosensitive drum 1 exhibits, for example, a cylindrical shape having a diameter of 108 mm and includes an a-Si (amorphous silicon) photosensitive layer on its surface. The photosensitive drum 1 is supported rotatably with a support member not illustrated, as well as is rotated/driven in a direction of an arrow R1 at a predetermined circumferential velocity of 600 mm/s by a driving unit not illustrated. For example, when a recording material S in an A4 size is transversely fed (in a long-edge feed manner), a monotone image can be formed at a maximum speed of 110 pages/minute. The photosensitive drum 1 having the a-Si photosensitive layer is more highly durable than a photosensitive drum having an organic photo-semiconductor (OPC) photosensitive layer used mainly for the image forming apparatus with low and medium speeds, and thus is suitable for the high speed image forming apparatus.

On the surface of the photosensitive drum 1, static charge is removed by a preexposure device 6*a* composed of an LED array 61 and the like, subsequently the surface is evenly charged to a predetermined potential, e.g., +500 V by a primary charging device 5, and then an electrostatic latent image is formed by an exposure device 6.

The exposure device includes a semiconductive member laser source (not illustrated) that emits laser light LB based on input image information. The surface of the photosensitive drum 1 after the primary charge is irradiated with the laser light LB through a polygon mirror, an fθ lens, a reflecting mirror, a dust-proof glass, and the like (all are not illustrated), and the electrostatic latent image is formed based on the input image information. The laser light LB has a wavelength of 670 nm and a resolution of 600 dpi. The surface potential on the photosensitive drum 1 after the exposure becomes, for example, about +130 V.

Subsequently, the electrostatic latent image is developed by a developing device 2 as a developing unit. A developer used in the present embodiment is a one-component type including no carrier particle and composed of magnetic toner alone. The toner is negatively charged and has a weight average particle diameter of, for example, 7 μm.

The developing device 2 is composed of a resinous developing container (housing) 20, a non-magnetic metallic developing sleeves as a developer bearing members 21*a*, 21*b*, a developer stirring feeding members 22*a*, 22*b*, 22*c*, a developing blade 23, and the like.

The toner in the developing device 2 is consumed with repetition of image output, and the toner is resupplied from a hopper (not illustrated) in the developing device 2. The resupplied toner is fed toward the developing sleeve 21*a* made from SUS304 that rotates in a direction of an arrow R21*a* at a circumferential velocity of 750 mm/s through the rotating developer stirring feeding members 22*a*, 22*b*, 22*c* that are resinous and ladder.

The two developing sleeves 21*a*, 21*b* are cylindrical members having a diameter of 30 mm, 20 mm, respectively which are rotatably supported to the developing container 20 through a shaft bearing (not illustrated), and supports a thin-layered toner layer on its surface. A secured permanent magnet not illustrated is incorporated therein.

With a rotation to the direction R21*a* of the developing sleeve 21*a*, the toner supported to the developing sleeve 21*a* is fed to a gap G2 (e.g., distance of 230 μm) between the developing sleeve 21*a* and the developing blade 23 that is magnetic metallic platy. While this toner is charged in negative polarity by an interaction between the permanent magnet (not illustrated) incorporated in the developing sleeve 21*a* and the magnetic developing blade 23, a toner thin layer having a predetermined thickness is formed. The thin-layered toner is subjected to the development in the gap G1*a* (e.g., distance of 250 μm) between the portion opposed to the photosensitive drum 1. A predetermined alternating developing bias is applied to the gap G1*a*.

With the rotation of the developing sleeve 21*b* in the direction of R21*b*, the toner supported by the developing sleeve 21*b* is fed to a gap 22 (e.g., distance of 230 μm) between the developing sleeves 21*a* and 21*b*. This toner is thin-layered in a predetermined thickness while this is charged in negative polarity by an interaction between the permanent magnet (not illustrated) secured and incorporated in the developing sleeve 21*b* and the permanent magnet (not illustrated) secured and incorporated in the developing sleeve 21*a*. The toner is subjected to the development in a gap G1*b* (e.g., distance of 300 μm) opposed to the photosensitive drum 1. A predetermined alternating developing bias is applied to the gap G1*b*.

The toner is supplied from the developing sleeves 21*a* and 21*b* as described above, so that the electrostatic latent image formed on the photosensitive drum 1 as described above is developed by the toner, and a toner image is formed on the photosensitive drum 1. The toner image formed on the photosensitive drum 1 is primarily transferred onto an intermediate transfer belt 39 (intermediate transfer member) that is an image bearing member or another image bearing member and a resinous endless belt in a contact portion (primary transfer portion) ZT1 between the photosensitive drum 1 and a primary transfer device 31 (transfer unit). The primary transfer device 31 is a roller made from an elastic body, to which a primary bias voltage is applied, and is pressed against an internal face of the intermediate transfer belt 39, and the intermediate transfer belt 39 is pressed against the photosensitive drum 1.

A sheet-like recording material (another image bearing member) S housed in a cassette 11 as a recording material housing device is sent one by one by a paper feeding roller. This recording material S is supplied with synchronizing with the toner image on the intermediate transfer belt 39 to a gap portion (secondary transfer portion) ZT2 between the intermediate transfer belt 39 and a secondary transfer device (transfer unit) 3 through a feeding roller, a registration roller, and the like. The toner image on the intermediate transfer belt 39 is secondarily transferred onto the supplied recording material S by the secondary transfer device 3.

The secondary transfer device 3 is composed of two rollers 32*e*, 32*i* made from the elastic body, to which a secondary bias voltage is applied. The roller 32*i* in the secondary transfer device is pressed against an internal face of the intermediate transfer belt 39, and the roller 32*e* out of the secondary transfer device is pressed against an external face of the intermediate transfer belt 39.

Transfer residual toner on the photosensitive drum 1 and transfer residual toner on the intermediate transfer belt 39 are temporarily collected by a photosensitive drum cleaning device (cleaning unit) 41 and an intermediate transfer belt cleaning device (cleaning unit) 42, respectively, and discharged to a collection device not illustrated.

Figure 3:
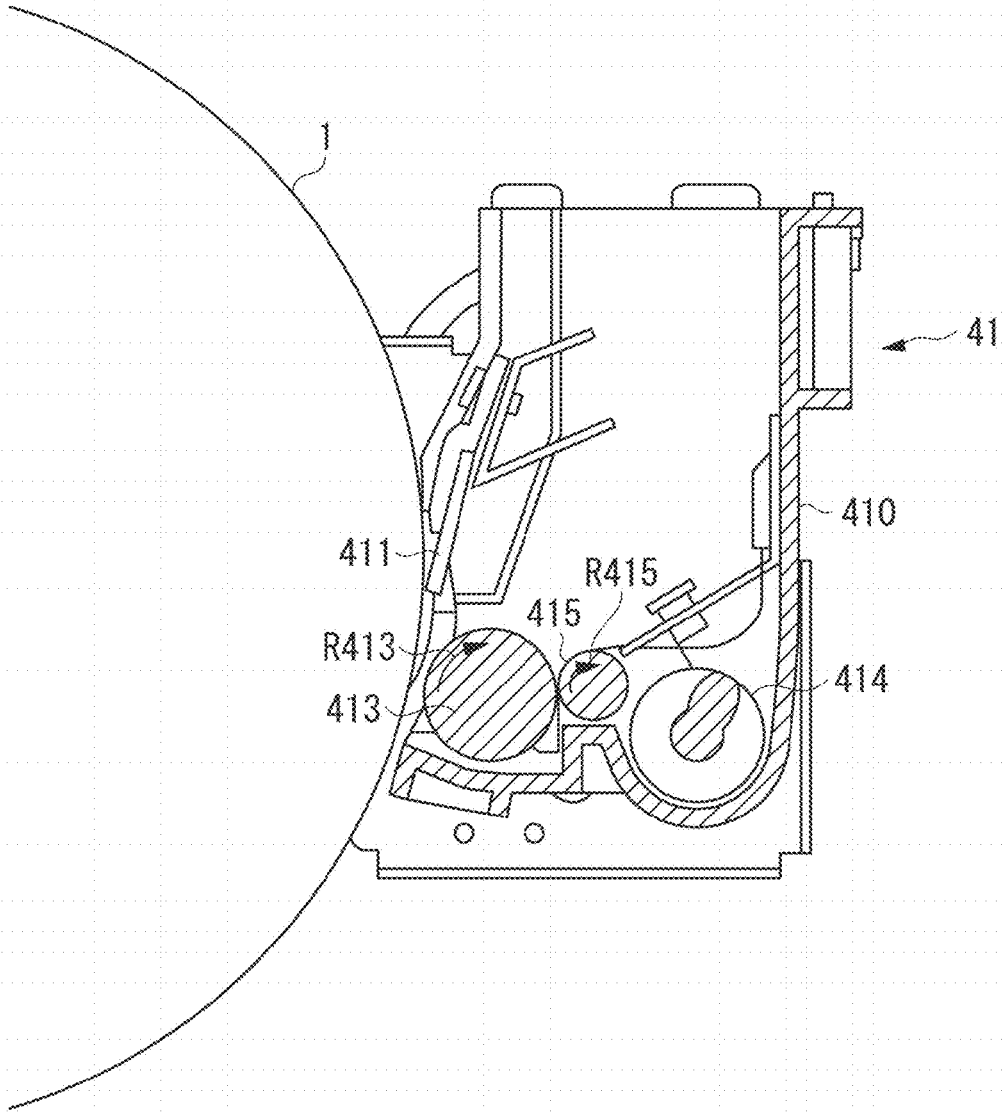
FIG. 3 is a schematic cross-sectional view of a cleaning device according to the first embodiment.

The photosensitive drum cleaning device 41 includes a platy cleaning blade 411 made from rubber that collects the transfer residual toner on the drum while it is pressed against the photosensitive drum 1, as shown in FIG. 3. The toner collected by the cleaning blade 411 is temporarily housed in a cleaning container (housing) 410 that supports the cleaning blade 411. The toner collected in the cleaning container 410 is discharged to a collection container not illustrated by a rotating screw type feeding member 414.

The photosensitive drum cleaning device 41 also includes a permanent magnet roller 413 that rotates in a direction of an arrow R413, as a cleaning aid unit. Magnetic brushes (not illustrated) that compose a toner layer composed of the once collected toner and having a constant thickness are formed on the permanent magnet roller 413 by utilizing a magnetic property of the toner. These magnetic brushes are uniformly formed by a toner layer thickness regulating member 415 that rotates in a direction of an arrow R415. The transfer residual toner on the photosensitive drum 1 is rubbed and removed by these magnetic brushes.

The intermediate transfer belt cleaning device 42 is slightly different from the photosensitive drum cleaning device 41 in details, e.g., in that it is pressed against the intermediate transfer belt 39, but its configuration itself is the same as that of the photosensitive drum cleaning device. Thus, the description for it is omitted.

As described above, a portion of the toner left on the surface of the photosensitive drum 1 after transferring the toner image is removed by the photosensitive drum cleaning device 41. Subsequently, the static charge is removed on the photosensitive drum 1 by the aforementioned preexposure device 6*a*, and then the photosensitive drum 1 is subjected again to subsequent image formation.

Meanwhile, the recording material S after transferring the toner image is separated from the surface of the intermediate transfer belt 39, and fed to a fixing device 7 by a conveyance belt 40. The recording material S is heated and pressurized by the fixing device 7, and the toner image is fixed on the surface thereof. The recording material S after fixing the toner image is discharged from an image discharge portion (not illustrated) out of the image forming apparatus, thereby completing the formation of the toner image on page one of the recording material S.

Figure 4:
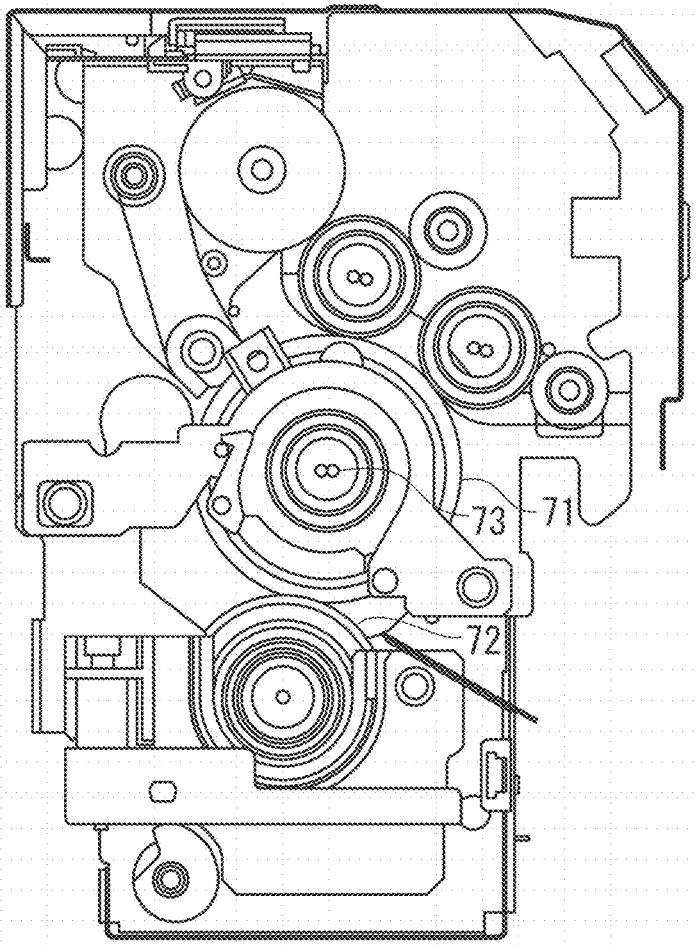
FIG. 4 is a schematic cross-sectional view of a fixing device according to the first embodiment.

The fixing device 7 includes a fixing roller 71 that is a rotating body provided with a fixing heater 73 therein and a pressing roller 72 that is a rotating body pressed against the fixing roller 71, as shown in FIG. 4. Then, a surface temperature of the fixing roller 71 is adjusted by controlling electric current that flows in the fixing heater 73 by a control device (not illustrated). The recording material S is heated and pressurized to fix the toner image during being supported and fed at a nip portion between the fixing roller 71 and the pressing roller 72.

[Toner Adhesion Preventing Member (Electric Field Forming Member)]

Figure 5:
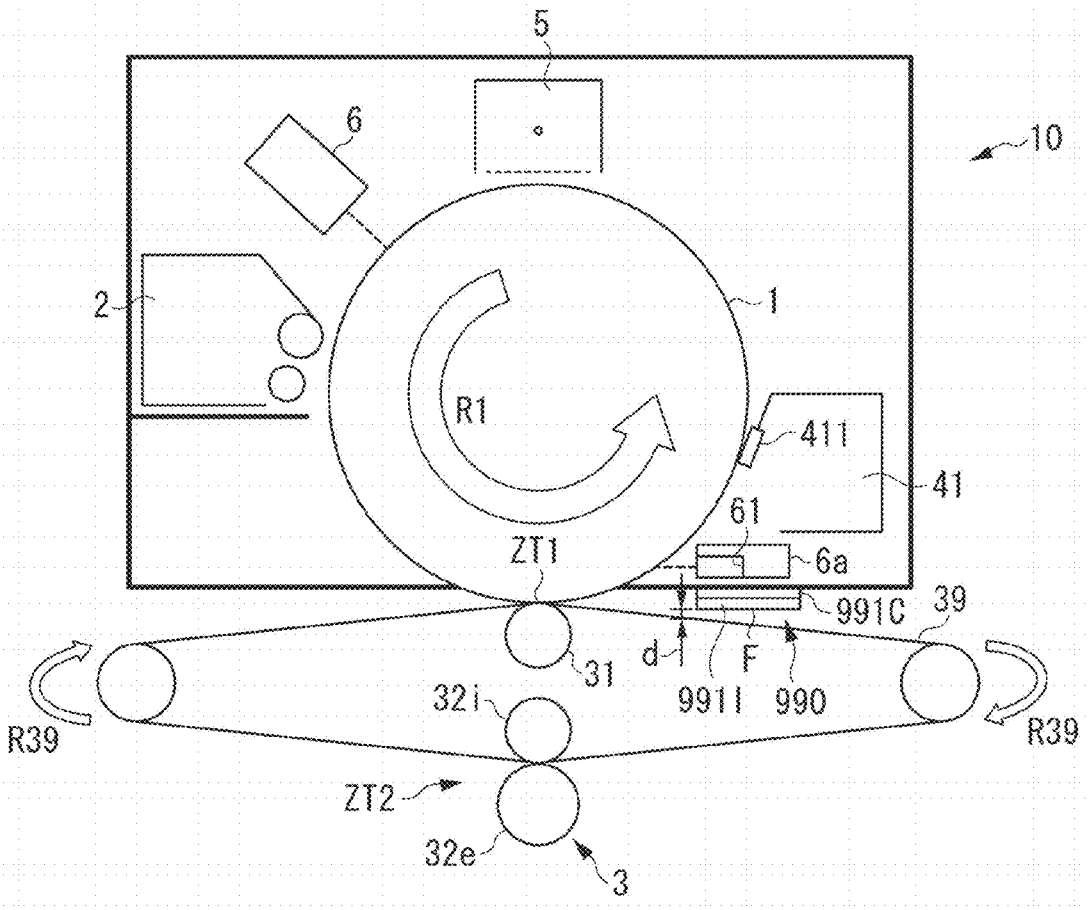
FIG. 5 is a schematic cross-sectional view of a relevant portion of the image forming apparatus for illustrating a location of a toner adhesion preventing member according to the first embodiment.

A toner adhesion preventing member 990 as a particle adhesion preventing member (electric field forming member) in the present embodiment will be described using FIG. 5 or FIG. 11. A shape shown in FIG. 5 is different from a shape shown in FIG. 1, but FIG. 5 is an outline framework for illustrating the arrangement of the toner adhesion preventing member, and the basic configuration itself is the same as that in FIG. 1.

In the present embodiment, a negatively charged particle is the toner. The present embodiment reduces the adhesion of the toner to an underside of a joining member 991C arranged below the photosensitive drum cleaning device 41, as well as prevents the toner from scattering from between this joining member 991C and the intermediate transfer belt 39. That is, in the present embodiment, the toner adhesion preventing member 990 is arranged downward the photosensitive drum cleaning device 41 and downstream of a rotation direction (movement direction) of the photosensitive drum 1 of the primary transfer device 31 as the transfer unit, which seems to be sites where the toner scatters. In the present embodiment, an image forming portion 10 that forms the toner image is composed of a photosensitive drum 1, a primary charging device 5, an exposure device 6, a developing device 2, an intermediate transfer belt 39, a preexposure device 6*a*, a photosensitive drum cleaning device 41, and the like, as shown in FIG. 5.

Figure 6:
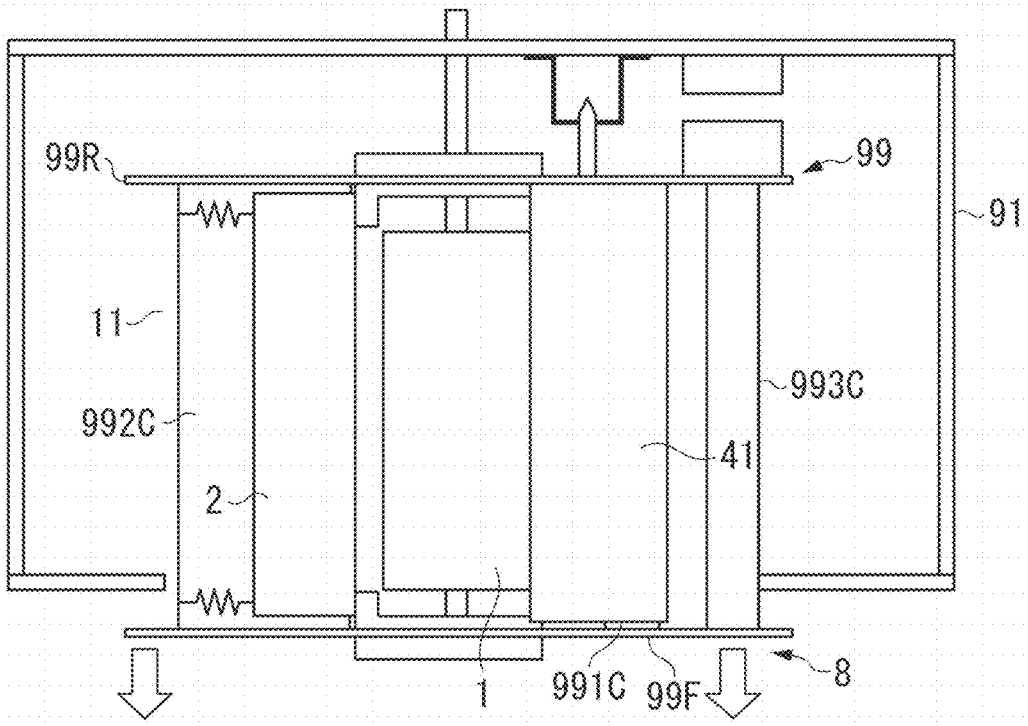
FIG. 6 is a schematic cross-sectional view showing a state viewed from an upper portion in FIG. 5 of a relationship between a frame of the image forming apparatus and a frame of image forming units according to the first embodiment.
Figure 7:
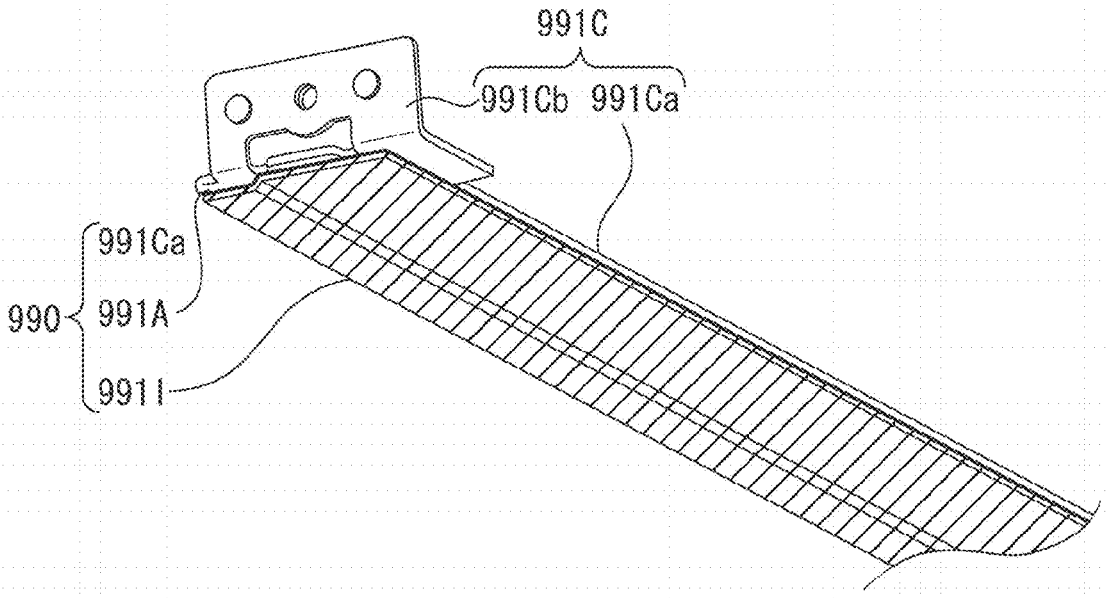
FIG. 7 is a perspective view of a joining member composing the frame of the image forming apparatus according to the first embodiment.

The image forming apparatus 100 of the present embodiment encloses major elements of the image forming portion 10 such as the photosensitive drum 1, the primary charging device 5, the developing device 2, the photosensitive drum cleaning device 41 and the like except for the intermediate transfer belt 39 and the exposure device 6 with an image forming portion frame 99 as shown in FIG. 6. The major elements of the image forming portion 10 and the image forming portion frame 99 compose an image forming portion element unit 8. The image forming portion element unit 8 can be drawn to a front side (side on which a user operates the apparatus in a placed state, downside in FIG. 6) from a frame 91 of the image forming apparatus 100.

The image forming portion frame 99 is composed of a platy member 99F on a front side and a platy member 9R on a rear side (upside in FIG. 6), and joining members 991C, 992C, 993C that attach these two platy members 99F, 99R. Of these, the joining member 991C is a metallic platy member located downward the photosensitive drum cleaning device 41 and downstream of the movement direction R39 of the intermediate transfer belt 39 for the primary transfer portion ZT1 when the image is formed, as shown in FIG. 5. The joining member 991C is connected to ground.

Such a joining member 991C provides both ends of a platy portion 991Ca having, for example, a width of 30 mm, a length of 340 mm and a thickness of 1 mm with a joining portion 991Cb that joins two platy members 99F, 99R. A basic function of the joining member 991C is to maintain strength of the image forming portion frame 99, but the toner that scatters at the primary transfer portion ZT1 easily adheres thereto due to the relation of the arrangement in the image forming apparatus. Also when the joining member 991C is connected to ground as a measure for electrostatic noise, the charged particle migrates along a line of electric force and adheres more easily.

In the case of the present embodiment, an insulating member 991I subsequently described is attached on one side of the platy portion 991Ca of such a joining member 991C to use as the toner adhesion preventing member 990. That is, the joining member 991C is the metallic platy member connected to the ground and thus becomes a conductive member with a constant potential (0 V). In other words, the joining member 991C is a constituent element that constitutes the image forming portion and works as the conductive member. The conductive member with the constant potential may be not only one connected to the ground but also one to which a constant voltage (e.g., +50 V) is applied.

Figure 8A:
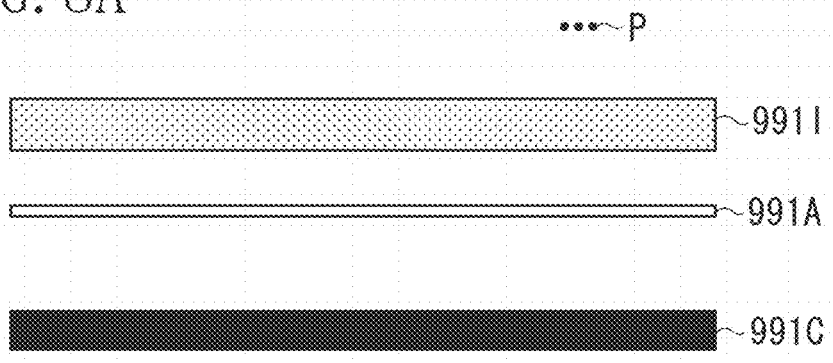
FIGS. 8A and 8B are a decomposed cross sectional view and a cross sectional view, respectively, schematically showing a toner adhesion preventing member according to the first embodiment.
Figure 8B:
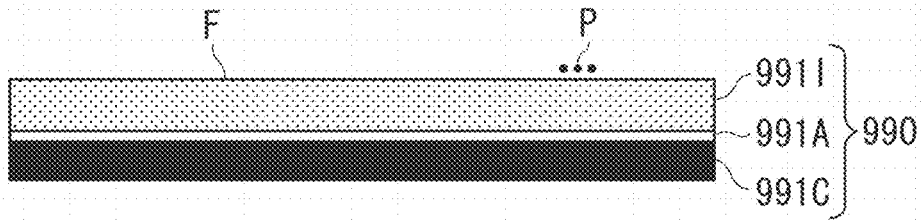

As illustrated in FIG. 8A and FIG. 8B, the insulating member 991I is adhered onto a side of the intermediate transfer belt 39 of the joining member 991C with an adhesive 991A. This adhesive 991A may be a material having conductivity or an insulation material.

As described above, the toner adhesion preventing member 990 attaching the insulating member 991I to the joining member 991C is closely situated and opposed to the surface of the intermediate transfer belt 39, a partner member of which is the surface (free surface F subsequently described) of the insulating member 991I. In the present embodiment, a distance d between the free surface F and the surface of the intermediate transfer belt 39 is 2 mm. As described later, this distance d is desirably minified in order to make it difficult to pass the toner between the toner adhesion preventing member 990 and the intermediate transfer belt 39 from the side of the photosensitive drum 1, and is for example, 10 mm or less and more desirably 5 mm or less. If the distance d is excessively reduced, this likely affects the toner image on the intermediate transfer belt 39. Thus, the distance is desirably 1 mm or more or 2 mm or more.

Figure 9:
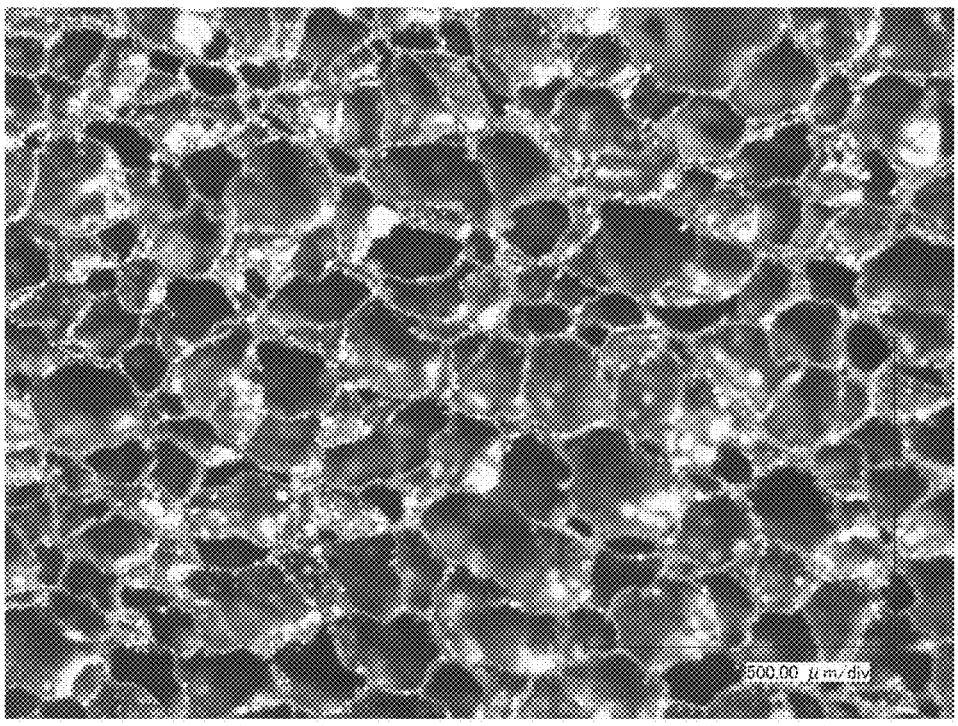
FIG. 9 is a magnified view of an insulating member.

Also in the case of the present embodiment, a porous material (foam member) as shown in FIG. 9 including ethylene propylene diene ternary copolymer (EPDM) excellent in negative chargeability is used as a material for the insulating member 991I. A density of the insulating member 991I is 0.2 g/cm$^3$ or less. A volume resistivity of the insulating member 991I is $10^{10}$ Ω·cm or more and $10^{16}$ Ω·cm or less. When the volume resistivity is less than $10^{10}$ Ω·cm, insulation quality is insufficient, and even if the toner adheres as described later, a surface potential is not increased sufficiently. On the other hand, it is difficult to obtain the insulation material, the volume resistivity of which is more than $10^{16}$ Ω·cm. Thus, the volume resistivity of the insulating member 991I in the present embodiment is $10^{10}$ Ω·cm or more and $10^{16}$ Ω·cm or less.

Particles charged in the same polarity as that of particles, adhesion of which is to be prevented are adhered onto a free surface side opposed to a side of the insulating member 991I attached to the joining member 991C. In the case of the present embodiment, the particle, the adhesion of which is to be prevented is negatively charged toner. Thus, a trace amount of the negatively charged toner P (FIGS. 8A and 8B) is directly adhered to a free surface F (FIG. 5, FIG. 8B) of the insulating member 991I. This free surface is a surface that does not come into contact with any part of the constituent elements of the apparatus.

When the trace amount of the negatively charged toner P is adhered onto the free surface F of the insulating member 991I, the surface potential on the free surface F is increased toward the negative polarity (i.e., the insulating member 991I is negatively charged), and the toner becomes difficult to adhere thereto any more. Actually, after placing the toner adhesion preventing member 990, the trace amount of the toner that scatters in the apparatus adheres onto the free surface of the insulating member 991I, and the surface potential of the free surface increases. When the surface potential is increased in this way, the further adhesion of the toner is prevented on the toner adhesion preventing member 990 doubling the joining member 991C. Also it becomes difficult to pass the toner between the toner adhesion preventing member 990 and the intermediate transfer belt 39 from the side of the photosensitive drum 1. The toner can be prevented from scattering beyond the toner adhesion preventing member 990 to a side opposed to the photosensitive drum 1. Also the toner present between the photosensitive drum 1 and the toner adhesion preventing member 990 adheres to the photosensitive drum 1 and is collected by the photosensitive drum cleaning device 41. Thus, scattering of the toner is prevented.

Also in the present embodiment, the length of the insulating member (length of a direction perpendicular to a direction in which the toner image is fed, length of a width direction of the intermediate transfer belt 39, length of a front and back direction in FIG. 1) is larger than the length of an image area formed on the intermediate transfer belt 39. For example, the length of the insulating member 991I is 340 mm and the length of the image area is 300 mm. A reason for this will be described.

As described above, in the present embodiment, an effect of preventing the adhesion of the toner is exerted by adhering the trace amount of the negatively charged toner on the foam member that meets the predetermined condition of EPDM. That is, it is desirable that the toner adhesion preventing member 990 is arranged at a location at which the charged toner is supplied to some extent. Thus, the free surface F of the insulating member 991I is arranged in a site opposed to a part of the image area in which the toner image is fed by the intermediate transfer belt 39 as the image bearing member that moves with bearing the toner image. The length of the insulating member 991I is larger than the length of the image area. A charge amount of the toner to be adhered is desirably −1 μC/g or more (absolute value, i.e., 1 μC/g or more on a negative polarity side).

Binders used for the toner in the present embodiment include, for example, homopolymer of styrene and substitutes thereof such as polystyrene, poly p-chlorostyrene, and polyvinyl toluene; styrene-based copolymers such as styrene-p-chlorostyrene copolymers, styrene-vinyl toluene copolymers, styrene-vinyl naphthalene copolymers, styrene methyl acrylate copolymers, styrene ethyl acrylate copolymers, styrene butyl acrylate copolymers, styrene 2-ethylhexyl acrylate copolymers, styrene octyl acrylate copolymers, styrene methyl methacrylate copolymers, styrene ethyl methacrylate copolymers, styrene butyl methacrylate copolymers, styrene methyl α-chloromethacrylate copolymers, styrene acrylonitrile copolymers, styrene vinyl methyl ether copolymers, styrene vinyl ethyl ether copolymers, styrene vinyl methyl ketone copolymers, styrene butadiene copolymers, styrene isoprene copolymers, styrene acrylonitrile indene copolymers, styrene maleic acid copolymers, and styrene maleate ester copolymers; polymethyl methacrylate, polybutyl methacrylate, polyvinyl chloride, polyvinyl acetate, polyethylene, polypropylene, polyester, polyurethane, polyamide, epoxy resins, polyvinyl butyral, polyacrylic acid resins, rosin, modified rosin, terpene resins, phenol resins, aliphatic or alicyclic hydrocarbon resins, aromatic petroleum resins, chlorinated paraffin, and paraffin wax, and these binders are used alone or in mixture.

All of known coloring agents can be used as the coloring agent used for the toner of the present embodiment. For example, dyes and pigments such as carbon black, iron black, graphite, nigrosine, metal complexes of monoazo dyes, ultramarine, copper phthalocyanine, methylene blue, chrome yellow, quinoline yellow, Hansa yellow, benzidine yellow, DuPont oil red, quinacridone, and various lake pigments can be used.

A content of such a coloring agent is desirably about 2 to 30 parts by weight based on 100 parts by weight of the binder in the case of non-magnetic toner particles. Also in the case of containing magnetic toner particles, the content of the coloring agent is desirably about 0.5 to 15 parts by weight based on 100 parts by weight of the magnetic toner particles.

A charge control agent is also added as needed for controlling a charge polarity and a charge amount of the toner. In the present embodiment, the charge control agent is not particularly limited and may be selected from the known charge control agents depending on the polarity and the charge amount of the objective toner. For example, metal complex salt azo-based dyes and nigrosine-based dyes are included, and these are selected depending on demand characteristics. The content of such a charge control agent is desirably about 0.2 to 10 parts by weight based on 100 parts by weight of the resin in the case of the non-magnetic toner particles. The content of the charge control agent is desirably about 0.2 to 10 parts by weight based on 100 parts by weight of the magnetic toner particles in the case of containing the magnetic toner.

Wax is also added as needed as a mold releasing agent upon fixing of the image for preventing offset. For example, various known waxes such as polyethylene wax, polypropylene wax and silicon wax may be used. The content of such a wax is desirably about 2 to 10 parts by weight based on 100 parts by weight of the binder in the case of non-magnetic toner particles. The content is desirably about 0.5 to 10 parts by weight based on 100 parts by weight of the resin in the magnetic toner.

Required ones are selected from the coloring agents, the charge control agents, the waxes, the magnetic powders, and the other additives as above, predetermined amounts thereof are melted and kneaded with the binder, and after cooling, the mixture is roughly pulverized using a hummer mill, a cutter mill, or the like. Subsequently, the pulverized one is further finely pulverized using a jet mill, an ang mill, or the like, and then sorted within a desirable volume average or number average particle diameter.

An internally loading additive or an externally loading additive such as a fluidity enhancer, a lubricant, an abrasive, a conductivity imparting agent, a fixing aid, and the like is added if necessary in addition thereto to the toner after such a sorting step. For example, known fine particles of silica, titanium oxide, resin powders described above as the toner binder, polytetrafluoroethylene powder, polyvinylidene fluoride powder, molybdenum disulfide, tungsten disulfide, boron nitride, lead oxide, antimony oxide, strontium sulfate, aluminium sulfate, calcium carbonate, strontium titanate, cerium oxide, strontium oxide metal salts of higher resin acid such as zinc stearate, graphite, barium fluoride, calcium fluoride, carbon fluoride, carbon black, conductive tin oxide and the like are available, and these sometimes have two or more functions simultaneously as the above functional agents.

The toner of the present embodiment is mixed with carrier particles such as iron powders, glass beads, nickel powders, and ferrite powders, and the mixture can also be used as a two component-based developer. When the toner is used as a one component-based magnetic developer, known magnetic materials such as ferromagnetic elements and alloys and compounds containing them, e.g., alloys and compounds of iron, cobalt, nickel, manganese and the like such as magnetite, hematite, and other ferromagnetic alloys may be contained as magnetic powders. These magnetic powders are fine powders having an average particle diameter of 0.3 to 5 μm and desirably 0.1 to 1 μm, and are added in an amount of 1 to 80% by weight and desirably 20 to 60% by weight based on the weight of the toner.

[Mechanism for Preventing Toner from Scattering]

Subsequently, a mechanism for preventing toner from scattering by the toner adhesion preventing member 990 will be described. As shown in aforementioned FIGS. 8A and 8B, the insulating member 991I that is the foam member (FIG. 9) is attached to one side of the joining member 991C that is the conductive member with the constant potential (e.g., 0 V), and the other side of the insulating member 991I, on which the joining member 991C is not attached is used as the free surface F. The trace amount of the particles P (e.g., toner)

having a negative-polarity charge amount (e.g., −5 to −20 μC/g) is adhered onto the free surface F on the insulating member 991I, so that a potential difference with strong negative polarity (e.g., −2000 V) is generated on the free surface F relative to the reference potential of the conductive member. In the present embodiment, since the conductive member is grounded at 0 V, a surface potential of −2000 V is formed on the surface layer of the insulting member. In a case where the conductive member is set to have a constant potential without being grounded, it is useful to make the potential of the conductive member constant such that the surface layer of the insulating member has a potential of −1000 V or higher. The surface of the insulating member has a large potential formed in the same polarity as that of toner. Therefore, the toner charged in the same polarity does not adhere to the charged surface, and thus the charged surface itself is not contaminated with the toner. Also the strong negative polarity prevents the toner from scattering near the charged surface.

Subsequently, a mechanism for charging the insulating member 991I will be described below. First similarly to FIGS. 8A and 8B, two types of the insulating members are compared by attaching the insulating member on a metal plate (corresponding to the joining member 991C) with a double stick tape (corresponding to the adhesive 991A). As the insulating member, a foam member of polyurethane was used in Comparative Example and a semi-independent semi-open cellular body of EPDM was used in Example. The surface potential on the insulating member when 0.001 g of the negatively charged toner was adhered thereon is shown in Table 1.

The charge amount of the toner at that time was −5 μC/g. This charge amount of the toner was measured using a Faraday cage. The Faraday cage is a coaxial double-structured cylinder, and an internal cylinder is insulated from an external cylinder. When a charged body with a charge amount Q is placed in this internal cylinder, the cylinder becomes a state as if a metallic cylinder with the charge amount Q is present by electrostatic induction. This induced charge amount is measured by KEITHLEY 616 Digital Electrometer, and the charge amount Q is divided by a weight M of the toner to represent Q/M (charge amount). The toner is directly placed in a filter by air aspiration.

TABLE 1

| | | | |
|---|---|---|---|
| Material | Polyurethane | polyurethane | Microcell polymer |
| Brand name | Calmfelex | Everlight | Poron |
| Part number | F-2G | VH | Standard |
| Supplier | Inoac | Bridgestone | Inoac |
| Volume resistivity | insulated | insulated | insulated |
| Density (g/cm$^3$) | 0.25 | 0.23 | 0.24 |
| Foaming state | Independent | Independent | Independent |
| Toner adhesion state | x | x | x |
| surface potential (V) | −20 or less | −20 or less | −20 or less |
| Material | chloroprene | Nitrile rubber | Nitrile rubber |
| Brand name | CR-based | NBR-based | BNR-based |
| Part number | C4205 | 4112 | 4413 |
| Supplier | Inoac | Y Company | Y Company |
| Volume resistivity | insulated | insulated | insulated |
| Density (g/cm$^3$) | 0.18 | 0.15 | 0.18 |
| Foaming state | Independent | Independent | Independent |
| Toner adhesion state | x | x | x |
| surface potential | −20 or less | −20 or less | −20 or less |
| Material | EPDM | EPDM | EPDM |
| Brand name | EPDM-based | EPDM-based | EPT-sealer |
| Part number | E4385 | E-4382 | EC100 |
| Supplier | Inoac | Inoac | Nitto Denko |
| Volume resistivity | Conductive | Insulated | Insulated |
| Density (g/cm$^3$) | 0.12 | 0.16 | 0.09 |

TABLE 1-continued

| | | | |
|---|---|---|---|
| Foaming state | Independent | Independent | Semi-independ* |
| Toner adhesion state | x | ○ | ○ |
| surface potential | −20 or less | −2000 | −2000 |
| Material | EPDM | EPDM | EPDM |
| Brand name | EPT-sealer | EPT-sealer | A |
| Part number | No. 681 | EC100 | EPDM A |
| Supplier | Nitto Denko | Nitto Denko | A Company |
| Volume resistivity | Insulated | Insulated | Insulated |
| Density (g/cm$^3$) | 0.09 | 0.11 | 0.2 |
| Foaming state | Independent | Semi-independ* | Independent |
| Toner adhesion state | ○ | ○ | ○ |
| surface potential | −2000 | −2000 | −2000 |
| Material | EPDM | EDPM | EDPM |
| Brand name | B | C | D |
| Part number | EDPM B | EDPM C | EDPM rubber |
| Supplier | B Company | C Company | D Company |
| Volume resistivity | Insulated | Insulated | Insulated |
| Density (g/cm3) | 0.25 | 0.28 | 0.9 |
| Foaming state | Independent | Independent | — |
| Toner adhesion state | x | x | x |
| surface potential | −20 or less | −20 or less | −20 or less |
| Material | EDPM | EDPM | High foaming silicon |
| Brand name | EPT-sealer | EPT-sealer | NanNex |
| Part number | SA-612 | SA-212 | TL4400 |
| Supplier | Nitto Denko | Nitto Denko | Inoac |
| Volume resistivity | Insulated | Insulated | Insulated |
| Density (g/cm$^3$) | 0.11 | 0.08 | 0.26 |
| Foaming state | Independent | Semi-independ* | Independent |
| Toner adhesion state | ○ | ○ | ○ |
| surface potential | −1600 | −1600 | −2000 |
| Material | High foaming silicon | High foaming silicon | High foaming silicon |
| Brand name | — | NanNex | NanNex |
| Part number | — | TL4401 | TL4402 |
| Supplier | — | Inoac | Inoac |
| Volume resistivity | Insulated | Insulated | Insulated |
| Density (g/cm$^3$) | 0.3 | 0.34 | 0.5 |
| Foaming state | Independent | Independent | Independent |
| Toner adhesion state | ○ | x | x |
| surface potential | −2000 | −20 or less | −20 or less |

As is evident from Table 1, whereas the surface potential was charged to only about −20 V or less in the case of the polyurethane foam member in Comparative Example, the surface potential was charged to −2000 V in the configuration using the EPDM foam member in Example. The surface potential is −20 V when the same toner was adhered onto the surface of a metallic plate to which no insulating member was attached. In order to fit an initial condition for any member, the static charge was removed with ethanol, and then examined.

Likewise, the surface potential was examined for the other materials. As is evident from Table 1, a conductive body such as E-4385 even derived from the same material EPDM did not exhibit the strong negative polarity. A rubber from a company D is an insulating body, but this also did not exhibit the strong negative polarity. Concerning the density, it was found that EPDM with a high density was not charged whereas EPDM having a low density of 0.2 g/cm$^3$ or less exhibited the strong negative polarity. Also in Table 1, an adherent state of the toner other than the trace amount of the toner that initially adhered is shown. Much adhesion of the toner and almost no adhesion of the toner are represented by x marks and ○ marks, respectively.

As is evident from Table 1, the surface potential was high in negative polarity and the adhesion of the toner was good only in the cases using EPDM having the density of 0.2 g/cm$^3$ or less in the materials examined. That is, even if EPDM is used, the lower the density is, the stronger negative polarity the material is charged to. As a result, the negatively charged toner that subsequently scatters is prevented from adhering due to an electrostatic force.

Figure 10:
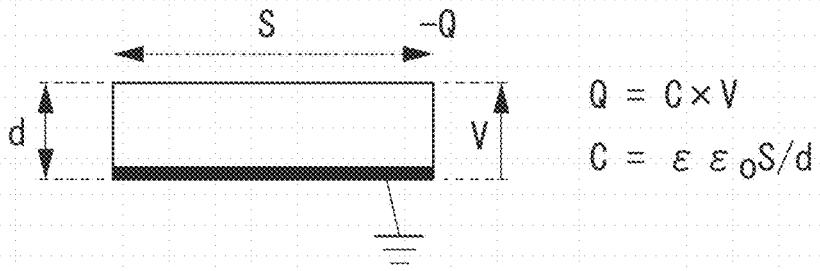
FIG. 10 is a simply modeled view for illustrating a mechanism of preventing the toner from scattering around.

This phenomenon is shown as a simple model in FIG. 10. When the toner with charge of −Q [μC/g] adheres onto the surface of the insulating member (foam member of EPDM), the surface potential V is V=Q/C[V]. C=ϵ (specific inductive capacity)×$\epsilon_0$ (vacuum inductive capacity)×S (area)/d (thickness)

Here, when the thickness d of the insulating member is 2 mm and the area surrounded by a periphery of the free surface is S, the area of the insulating member obtained by subtracting cells on the free surface is dependent on the density. For example, the density in the case of the foam member including EPDM having the density of 0.09 g/cm$^3$ is 1/10 relative to the density in the case of the rubber material including EPDM having the density of 0.9 g/cm$^3$. Here, when the height of the rubber material and the foam member is constant, the area becomes about 1/10 (actually the density in a height direction is reduced, and thus the density becomes 1/10 or more).

Meanwhile, air layers and sponge layers are present in disorder in the configuration of the foam member, which has a complicated configuration, as shown in FIG. 9. It does not seem in calculation that the potential is amplified to 100 folds. In this regard however, as is evident from Table 1, the rubber material including EPDM having the density of 0.9 g/cm$^3$ was charged to −20 V and the foam member including EPDM having the density of 0.09 g/cm$^3$ was charged to −2000 V. That is, the present inventor has found that the insulating member having the limited configuration as described above amplifies the potential to about 100 folds relative to the rubber material by the trace amount of the charge.

Although such a configuration cannot be explained quantitatively, it is thought that an apparent electric capacity becomes 1/100 relative to the rubber material by taking the configuration of the foam member in which the aforementioned density and the electric nature are limited. EPDM originally has a nature to easily have the negative polarity like polyethylene according to the triboelectric series shown in FIG. 11. Generally, the toner is composed of the resins such as polyester and styrene acryl, and EPDM has a characteristic to be more easily charged to the negative polarity than these resins in the triboelectric series. Therefore, it is desirable to use those that are porous materials charged to more negative polarity than the resin that composes the toner (particle to be prevented from adhering) and have the density of 0.2 g/cm$^3$ or less as the insulating member.

The porous material having the density of less than 0.01 g/cm$^3$ is difficult to be produced. The density and cell sizes of such a porous material become unstable. Also the strength to some extent is required. Thus, the density of the insulating member is recommended to be 0.01 g/cm$^3$ or more. A desirable range of a lower limit of the density of the insulating member is 0.03 g/cm$^3$ or more, and a more desirable range thereof is 0.05 g/cm$^3$ or more.

As described above, since EPDM has the characteristic to be easily charged to the negative polarity, the trace amount of the negatively charged toner adheres onto the surface of the insulating member that meets the above condition, thereby making the surface layer with high negative potential. Together with this, because of being insulated, the charge (potential) can be kept to the negative polarity for a long period of time. Thus, the negatively charged toner does not adhere electrostatically any more. For those, the adhesion of which was evaluated to be good in Table 1, the image was formed on 10,000 sheets, and then the surface potential on the insulating member was examined. As a result, the surface potential was charged at −1800 V. Thus it was found that the toner contamination did not occur principally and electrostatically. For comparison, even when a tape made from polytetrafluoroethylene easily charged in the negative polarity was attached on a metal connected to the ground, the tape was stained with the toner because it did not exhibit the strong negative charge. Thinking from this, it is found that the amplification of the surface potential is a specific phenomenon.

Subsequently, a method for producing the EPDM foam member as the insulating member of the present embodiment will be described. The EPDM foam member is obtained by foaming a foaming composition containing ethylene propylene diene rubber, a vulcanizing agent, a vulcanization accelerator, a foaming agent and a foaming aid.

EPDM is a rubber obtained by copolymerizing ethylene, propylene and dienes. An unsaturated bond made by copolymerizing an ethylene propylene copolymer with dienes enables vulcanization by the vulcanizing agent. Examples of dienes include 5-ethylidene-2-norbornene, 1,4-hexadiene, and dicyclopentadiene.

A content of diene is, for example, 3 to 10% by weight in EPDM. Examples of the vulcanizing agent include sulfur, serene, magnesium oxide, lead monoxide, organic peroxides (e.g., cumene peroxide), polyamines, oximes (e.g., p-quinone dioxime, p,p'-dibenzoylquinone dioxime, and the like), nitroso compounds (e.g., p-di nitrosobenzine and the like), resins (e.g., alkyl phenol/formaldehyde resins, melamine/formaldehyde condensates and the like), and ammonium salts (e.g., ammonium benzoate and the like). Sulfur is preferred in terms of durability attributed to a vulcanizing property of the obtained EPDM foam member. The vulcanizing agent may be used alone or in combination of two or more. A rate of the vulcanizing agent to be combined may be selected appropriately because a vulcanizing efficiency is different depending on its type, and for example, is 0.5 to 3 parts by weight based on 100 parts by weight of EPDM in the case of sulfur.

The vulcanization accelerator contains a thiourea-based vulcanization accelerator, a thiazole-based vulcanization accelerator, a dithiocarbamate-based vulcanization accelerator and a thiuram-based vulcanization accelerator. Desirably the vulcanization accelerator consists of these four vulcanization accelerators.

The thiourea-based vulcanization accelerator is selected from N,N'-diethyl thiourea, N,N'-dibutyl thiourea, N,N'-diphenyl thiourea, and trimethyl thiourea.

The thiazole-based vulcanization accelerator is selected from 2-mercaptobenzothiazole, zinc salts of 2-mercaptobenzothiazole, cyclohexylamine salts of 2-mercaptobenzothiazole, and dibenzothiazyl disulfide.

The dithiocarbamate-based vulcanization accelerator is selected from zinc diisononyl dithiocarbamate and zinc dibenzyl dithiocarbamate.

The thiuram-based vulcanization accelerator is selected from tetraxis (2-ethylhexyl)thiuram disulfide and tetrabenzylthiuram disulfide.

The vulcanization accelerator contains the thiourea-based vulcanization accelerator, the thiazole-based vulcanization accelerator, the dithiocarbamate-based vulcanization accelerator and the thiuram-based vulcanization accelerator at a ratio of 1 to 20/1 to 20/1 to 20/1 to 30, desirably 1 to 15/1 to 10/1 to 10/1 to 30 and more desirably 2 to 15/2 to 7/1 to 5/1 to 25 as a weight ratio of the thiourea-based vulcanization accelerator/thiazole-based vulcanization accelerator/dithiocarbamate-based vulcanization accelerator/thiuram-based vulcanization accelerator. The rate of the vulcanization accelerator to be combined is 1.0 to 7.0 parts by weight based on 100 parts by weight of EPDM.

Examples of the foaming agent include organic foaming agents such as azo-based compounds such as azodicarbonamide (ADCA), barium azodicarboxylate, azobisisobutyronitrile (AIBN), azocyclohexylnitrile and azodiaminobenzene; hydrazide-based compounds such as 4,4'-oxybis (benzenesulfonyl hydrazide) (OBSH), para-toluenesulfonyl hydrazide, diphenylsulfone-3,3'-disulfonyl hydrazide, 2,4-toluenedisulfonyl hydrazide, p,p-bis(benzenesulfonyl hydrazide) ether, benzene-1,3-disulfonyl hydrazide and allybis(sulfonyl hydrazide); semicarbazide-based compounds such as toluylenesulfonyl semicarbazide and 4,4'-oxybis (benzenesulfonyl semicarbazide); alkane fluoride such as trichloromonofluoromethane and dichloromonofluoromethane; triazole compounds such as 5-morphoryl-1,2,3,4-thiatriazole; as well as inorganic foaming agents such as hydrogen carbonate salts such as sodium hydrogen carbonate and ammonium hydrogen carbonate; nitrite salts such as sodium nitrite and ammonium nitrite; borohydride salts such as sodium borohydride; and azides. Desirably, the organic foaming agents, more desirably the azo-based compounds and still more desirably azodicarbonamide (ADCA) are included.

A thermally expandable microparticle in which a thermally expandable substance is enclosed in a microcapsule may be used as the organic foaming agent. For example, commercially available products such as Microsphere (brand name manufactured by Matsumoto Yushi-Seiyaku Co., Ltd.) may be used as such a thermally expandable microparticle. The rate of the foaming agent to be combined is 5 to 25 parts by weight based on the 100 parts by weight of EPDM. Examples of the foaming aid include urea-based compounds, salicylate-based compounds and benzoate-based compounds. Desirably the urea-based compounds are included. The rate of the foaming aid to be combined is 1 to 15 parts by weight and desirably 2 to 10 parts by weight based on 100 parts by weight of EPDM. The foaming composition can appropriately contain the vulcanization aid, the lubricant, a filler, pigments, a softener if necessary.

Examples of the vulcanization aid include zinc oxide, and the like. The rate thereof to be combined is 2 to 10 parts by weight based on 100 parts by weight of EPDM. Examples of the lubricant include stearic acid and esters thereof, and the like. The rate thereof to be combined is 0.5 to 5 parts by weight and desirably 1 to 3 parts by weight based on 100 parts by weight of EPDM.

Examples of the filler include inorganic fillers such as calcium carbonate (e.g., heavy calcium carbonate), magnesium carbonate, calcium hydroxide, magnesium hydroxide, aluminium hydroxide, silicic acid and salts thereof, clay, talc, mica powder, bentonite, silica, alumina, aluminium silicate, acetylene black and aluminium powder; organic fillers such as cork; and other known fillers, and desirably the inorganic fillers, and more desirably calcium carbonate. The rate of the filler to be combined is 200 parts by weight or less based on 100 parts by weight of EPDM.

Examples of the pigment include carbon black and the like. The rate thereof to be combined is 0.5 to 50 parts by weight based on 100 parts by weight of EPDM.

Examples of the softener include dry oils and animal and plant oils (e.g., linseed oil), paraffin, asphalt, petroleum-based oils (e.g., paraffin-based processed oils, naphthene-based processed oils, aromatic processed oils), low molecular weight polymers, organic acid esters (e.g., phthalate ester, e.g., di-2-ethylhexyl phthalate (DOP), dibutyl phthalate (DBP), phosphate esters, higher fatty acid esters, alkyl sulfonate esters), and tackifiers, and desirably paraffin, asphalt, and the petroleum-based oils. The rate of the softener to be combined is 50 to 200 parts by weight based on 100 parts by weight of EPDM.

Further if necessary, the foaming composition can appropriately contain known additives such as a plasticizer, an anti-aging agent, an antioxidant, a coloring agent, an antifungal agent, and a flame retardant in the range in which excellent effects of the obtained EPDM foam member is not influenced.

Subsequently, the method for producing the EPDM foam member will be described. To produce the EPDM foam member, first a foaming composition as a mixture is prepared by combining and kneading the aforementioned respective ingredients using a kneader, a mixer or a mixing roll. In the preparation step, the kneading can also be carried out with appropriately heating. Also in the preparation step, for example, the ingredients other than the vulcanizing agent, the vulcanization aid, the foaming agent and the foaming aid can also be kneaded to prepare a primary admixture, and then the vulcanizing agent, the vulcanization aid, the foaming agent and the foaming aid can be added to and kneaded with the primary admixture to prepare a foaming composition (secondary admixture). A part of the vulcanization aid (e.g., thiourea vulcanization aid) can also be combined when the primary admixture is prepared.

A scorch time $t_5$ (in accordance with JIS K 6300-1) at 120° C. of the prepared foaming composition is, for example, 20 minutes or more and desirably 30 minutes or more. The prepared foaming composition is extruded and molded into a sheet-shaped product using an extruder (molding step), and the extruded and molded foaming composition is vulcanized and foamed with heating (foaming step).

The foaming composition is appropriately selected depending on vulcanization initiation temperature of the vulcanizing agent to be combined and foaming temperature of the foaming agent to be combined, and is preheated at 60 to 160° C. for 5 to 40 minutes, and then heated at 120 to 250° C. for 15 to 50 minutes using, for example, a hot wind circulation system oven.

The prepared foaming composition can also be continuously extruded and molded into a sheet-shaped product with heating using the extruder to continuously vulcanize and foam the foaming composition. This vulcanizes the foaming composition while foaming the foaming composition to produce the EPDM foam member.

The density of the foam member can be controlled by controlling the amount of the foaming agent to be combined, treatment time and temperature for the vulcanization and foaming. Basically, the more the amount of the foaming agent is, the easier the foaming is, as well as the higher the temperature is and the longer the treatment time is, the faster the foaming progresses. Among them, optimal values are obtained.

The density can also be adjusted in a penetration step before a heating step for foaming. The penetration step is a step of penetrating inert gas (e.g., carbon dioxide gas) that becomes the foaming agent into a subject to be foamed under high pressure. For comparison, the larger the amount of the inert gas, i.e., a penetration amount relative to the subject to be foamed is, the subject to be foamed is foamed more easily.

The method for producing the foam member is not limited to the above, the foam member may be produced by a known production method. Silicon described later can also be foamed and formed by the same method.

Subsequently, the toner adhesion state and the surface potential were examined when the member exposed to the scattering toner was the conductive member alone, the insulating member of polyurethane alone, and the insulating member (part number in Table 1: EC100) attached to the conductive member. These results are shown in Table 2.

TABLE 2

| Member exposed to scattering toner | Conductive member alone | Insulation member (polyurethane alone) | Conductive member + Insulation member (EC100) |
|---|---|---|---|
| Toner adhesion state | x | x | ○ |
| Surface potential (V) | 0 | −20 | −2000 |

As is evident from Table 2, it is found that only the insulating member attached to the conductive member that meets the condition of the present embodiment can effectively prevent the adhesion of the toner.

As described above, in the case of the present embodiment, the further adhesion of particles can be prevented by adhering the toner charged in the same polarity as in the toner, the adhesion of which is to be prevented, onto the side of the free surface of the insulating member 991I. Thus, the adhesion of the toner can be prevented without providing an apparatus that applies the voltage. As a result, the image forming apparatus incorporating the toner adhesion preventing member 990 is prevented from increasing in cost and size. Further, the maintenance cost of this apparatus can be reduced.

Example 1

Subsequently, results of an experiment in which the configuration of the present embodiment was actually applied will be described. In the experiment, the one obtained by attaching an insulating member 991I (part number in Table 1: EC100) having a width of 3 mm, a length of 340 mm and a thickness of 1 mm to a joining member 991C with an adhesive 991A (double-stick tape) having a thickness of 0.5 mm was used as a toner adhesion preventing member 990. A distance d between the toner adhesion preventing member 990 and an intermediate transfer belt 39 was 2 mm. Results of this experiment are shown as Example 1 in Table 3.

TABLE 3

| | Developer one components | Loading cost (Absolute value) | Maintenance cost (Absolute value) |
|---|---|---|---|
| Example 1 | One component | ○ | ○ |
| Example 2 | One component | ○ | ○ |
| Example 3 | Two components | ○ | ○ |
| Example 4 | One component | ○ | ○ |
| Example 5 | One component | ○ | ○ |
| Example 6 | Two components | ○ | ○ |
| Example 7 | One component | ○ | ○ |
| Example 8 | One component | ○ | ○ |
| Example 9 | One component | ○ | ○ |
| Example 10 | One component | ○ | ○ |
| Conventional Example 1 | One component | ○ | x |
| Conventional Example 2 | Two components | ○ | x |
| Conventional Example 3 | Two components | x | ○ |

| | Location of toner adhesion preventing member | | | |
|---|---|---|---|---|
| | Near developing device | Near Cleaning device | Joining member | Other location |
| Example 1 | Absence | Absence | Presence (Doubled) | Absence |
| Example 2 | Presence (Under developing container) | Absence | Absence | Absence |
| Example 3 | Presence (Backside of developing blade) | Absence | Absence | Absence |
| Example 4 | Absence | Presence (Inside of photo-sensitive drum) | Absence | Absence |
| Example 5 | Absence | Presence (Inside of photo-sensitive drum) (divided) | Absence | Absence |
| Example 6 | Presence (Side of developing sleeve of developing container) | Absence | Absence | Absence |
| Example 7 | Absence | Presence (Down-ward of inter-mediate transfer belt) | Absence | Absence |
| Example 8 | Absence | Absence | Presence | Downward of intermediate transfer belt |
| Example 9 | Absence | Presence (Bottom out of image for photo-sensitive drum) | Absence | Absence |
| Example 10 | Absence | Absence | Absence | Preexposure LED array |
| Conventional Example 1 | Absence | Absence | Absence | Absence |
| Conventional Example 2 | Absence | Absence | Absence | Absence |
| Conventional Example 3 | Presence (Bias was applied to metal plate on side of developing blade) | Absence | Absence | Absence |

| | Toner adhesion state (Addressed site) |
|---|---|
| Example 1 | ○ |
| Example 2 | ○ |
| Example 3 | ○ |
| Example 4 | ○ |
| Example 5 | ○ |

TABLE 3-continued

| | |
|---|---|
| Example 6 | ○ |
| Example 7 | ○ |
| Example 8 | ○ |
| Example 9 | ○ |
| Example 10 | ○ |
| Conventional Example 1 | x |
| Conventional Example 2 | x |
| Conventional Example 3 | ○ |

In Tables 2 and 3, it is indicated by 0 marks that apparatus cost was better than in Conventional Example 1 (x marks) described later, and it is also indicated by ○ marks that the toner adhesion state in the site provided with the toner adhesion preventing member (addressed site) was better than in Conventional Examples 1 and 2 (x marks) described later. It is also indicated by ○ marks that maintenance cost was better than in Conventional Examples 1 and 2 (x marks) described later. According to Table 3, it is found that Example 1 is high in superiority for the cost. In this way, the configuration that was low price and required no cleaning maintenance by a service engineer was able to be realized.

Conventional Examples 1

Here, Conventional Example 1 in Table 3 will be described. In Conventional Example 1, any part in the image forming apparatus was provided with no toner adhesion preventing member. In the case of such Conventional Example 1, a maintenance frequency is increased (cleaning is required every about 100,000 sheets of image output), and a maintenance cost is increased because the toner scatters apart to adhere to various portions in the image forming apparatus.

On the other hand, in Example 1, the scattering toner was able to be prevented from adhering to the joining member 991C, and the further scattering of the toner was able to be prevented. In Example 1, the distance d between the toner adhesion preventing member 990 and the intermediate transfer belt 39 is reduced to narrow a space where the scattering toner can move. Thus, the toner that scattered at the primary transfer portion cannot move to a right side in FIG. 5 due to the electric field generated by the toner adhesion preventing member 990, and is attracted to the photosensitive drum 1 after the primary transfer. Finally, the toner is collected to the photosensitive drum cleaning device 41. Therefore, the scattering of the toner in the apparatus was able to be prevented and no cleaning by the service engineer was required until 10,000,000 sheets of the image were output.

Figure 12:
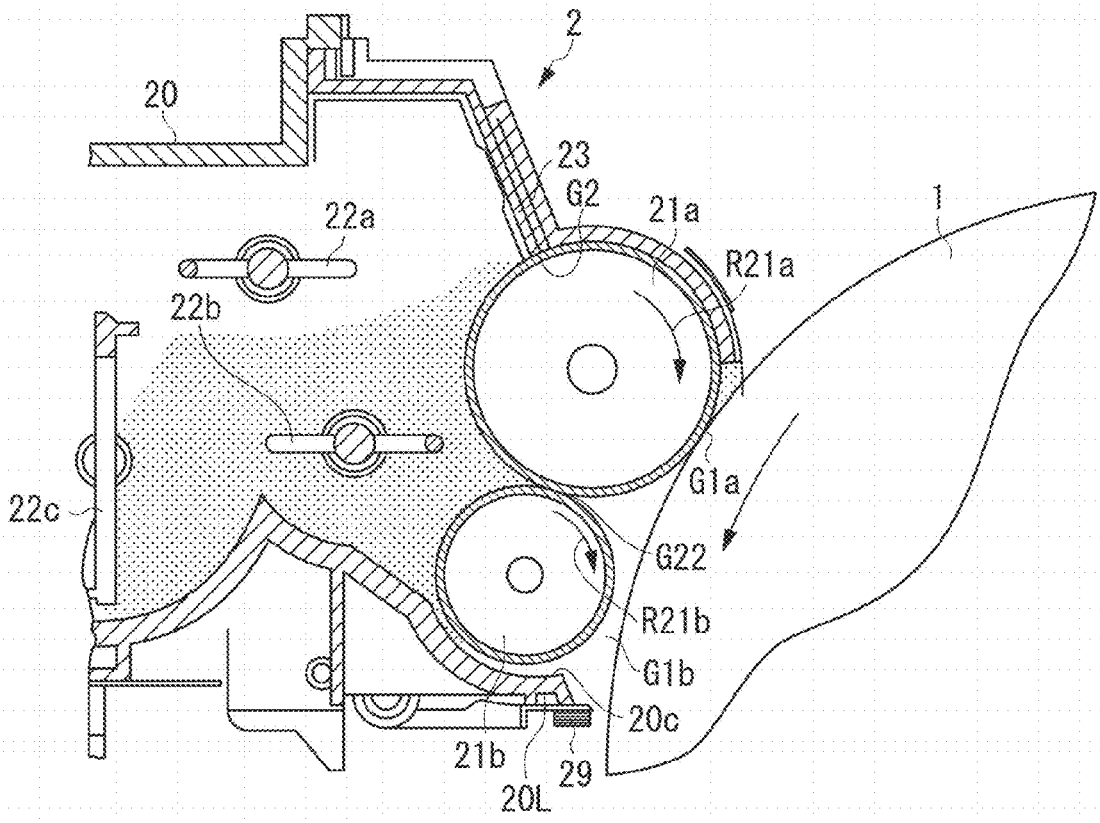
FIG. 12 is a schematic cross-sectional view of a developing device according to a second embodiment of the present invention.

A second embodiment of the present invention will be described using FIG. 12. The present embodiment reduces the toner scattering that occurs on a downstream side of a rotation direction of the photosensitive drum 1 in the developing device 2. Thus in the present embodiment, a downside of an opening 20*c* (vicinity of the opening) opposed to the photosensitive drum 1 in the developing container in the developing device 2 is provided with a toner adhesion preventing member 29. Foaming silicon is used as the insulating member that composes the toner adhesion preventing member 29. The other basic configuration of the image forming apparatus is the same as that in the first embodiment as described above. Thus, points that are different from those in the first embodiment will be mainly described below.

In the case of the present embodiment, as a part where the toner scatters in the apparatus, a lower part 20L of the opening 20*c* in the developing container 20 is provided with the toner adhesion preventing member 29. In the present embodiment, the developing container 20 is made from a resin, and thus, the toner adhesion preventing member 29 is made by attaching the insulating member (e.g., TL4400 in Table 1) composed of foaming silicon (particularly high foaming silicon) to one side of a metal plate made from aluminium alloy as a conductive member. The free surface of the insulating member is arranged with facing downward of the developing container 20. The metal plate is connected to ground, and the surface potential is kept at 0 V.

The insulating member of the present embodiment is a porous material composed of silicon (foaming silicon) and has a density of 0.3 g/cm$^3$ or less. As is evident from aforementioned Table 1, when the toner adhesion state was observed in the cases of the insulation foaming bodies formed from various materials, it was found that the toner adhesion was prevented in the cases of the high foaming silicon and the low density (e.g., 0.26 g/cm$^3$). The surface potential on such a material is −2000 V that is high, and this does not attract the negatively charged toner. However, even in the case of the foaming silicon, if the density was high, e.g., 0.34 g/cm$^3$ in TL4401, the toner adhesion occurred. As a result of examining the density in detail, it was found that the toner adhesion was able to be prevented when the density was 0.3 g/cm$^3$ or less in the case of the foaming silicon. The present embodiment took advantage of this property. The lower limit of the density is 0.01 g/cm$^3$ or more in terms of foaming stability and strength. The desirable range of the lower limit of the density of the insulating member is 0.03 g/cm$^3$ or more and more desirably 0.05/cm$^3$ or more.

Figure 11:
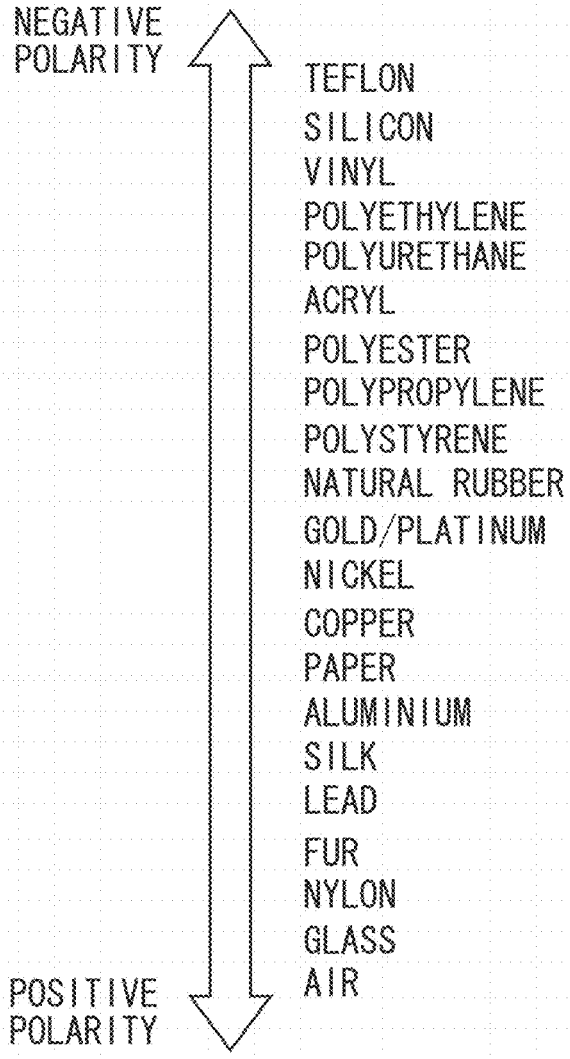
FIG. 11 is a view showing triboelectric series of various materials.

According to the triboelectric series in FIG. 11, silicon is easily charged in negative polarity by its nature. Generally, the toner is composed of polyester, styrene, acryl, and the like, and silicon has the characteristic to be easily charged in more negative polarity than these materials in the triboelectric series.

Such a toner adhesion preventing member 29 is attached onto the lower part 20L of the developing container 20 with the double stick tape. This prevents the scattering toner from adhering to the lower part 20L. Thus, this can reduce a phenomenon that the scattering toner adheres to and accumulates on the lower part 20L of the developing container 20 to drop downward of the developing container 20. Also this can reduce the stain of the toner image on the intermediate transfer belt 39 arranged under the developing container 20.

Scattering toner that occurs between the developing sleeves 21*a*, 21*b* and the photosensitive drum 1 in a developing step is unlikely to move to the downside of the developing container 20 due to the strong negative polarity of the toner adhesion preventing member 29 provided on the lower part 20L. Thus, the scattering toner is attracted onto the side of the developing sleeves 21*a*, 21*b* after the developing step. Thus, the toner scattering to the downside of the developing container 20 can be reduced.

Example 2

Subsequently, results of an experiment in which the configuration of the present embodiment was actually applied will be described. In the experiment, the one obtained by attaching a porous insulating member (silicon foam member, part number: TL4400) to an aluminium plate as the conductive member with the double stick tape was used as the toner adhesion preventing member 29. The aluminium plate has a rectangular shape having a width of 3 mm, a length of 340 mm and a thickness of 0.5 mm. The insulating member has a width of 3 mm, a length of 340 mm and a thickness of 1 mm. The double stick tape has a thickness of 0.5 mm. The results of this experiment are shown as Example 2 in aforementioned Table 3.

In Example 2, compared with Conventional Example 1, the toner contamination in the developing device and the apparatus was remarkably improved, and the frequency of the maintenance by cleaning in the apparatus was reduced to 1/10 or less. As a result, the maintenance cost was able to be reduced.

Figure 13:
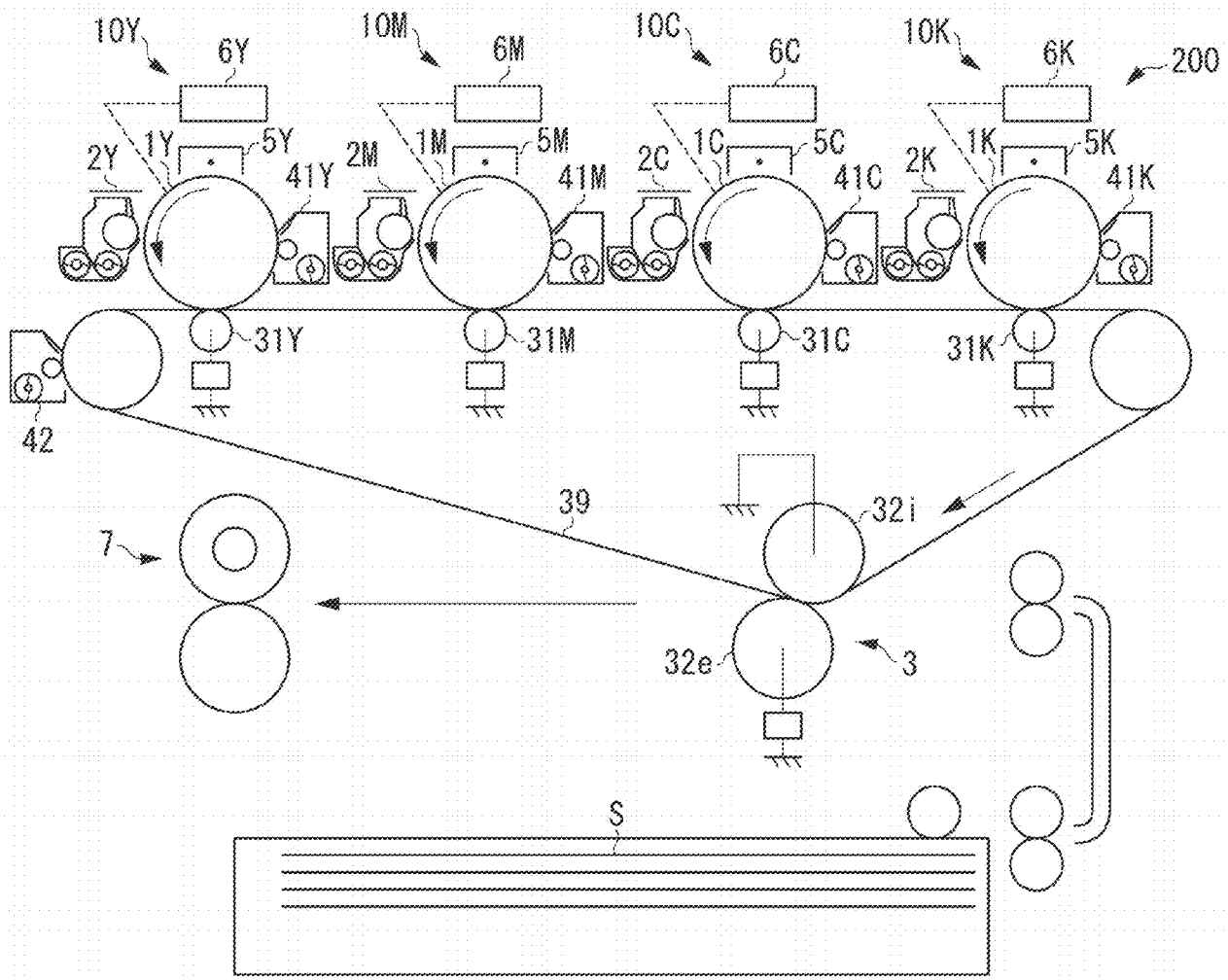
FIG. 13 is a schematic cross-sectional view of an image forming apparatus according to a third embodiment of the present invention.
Figure 17:
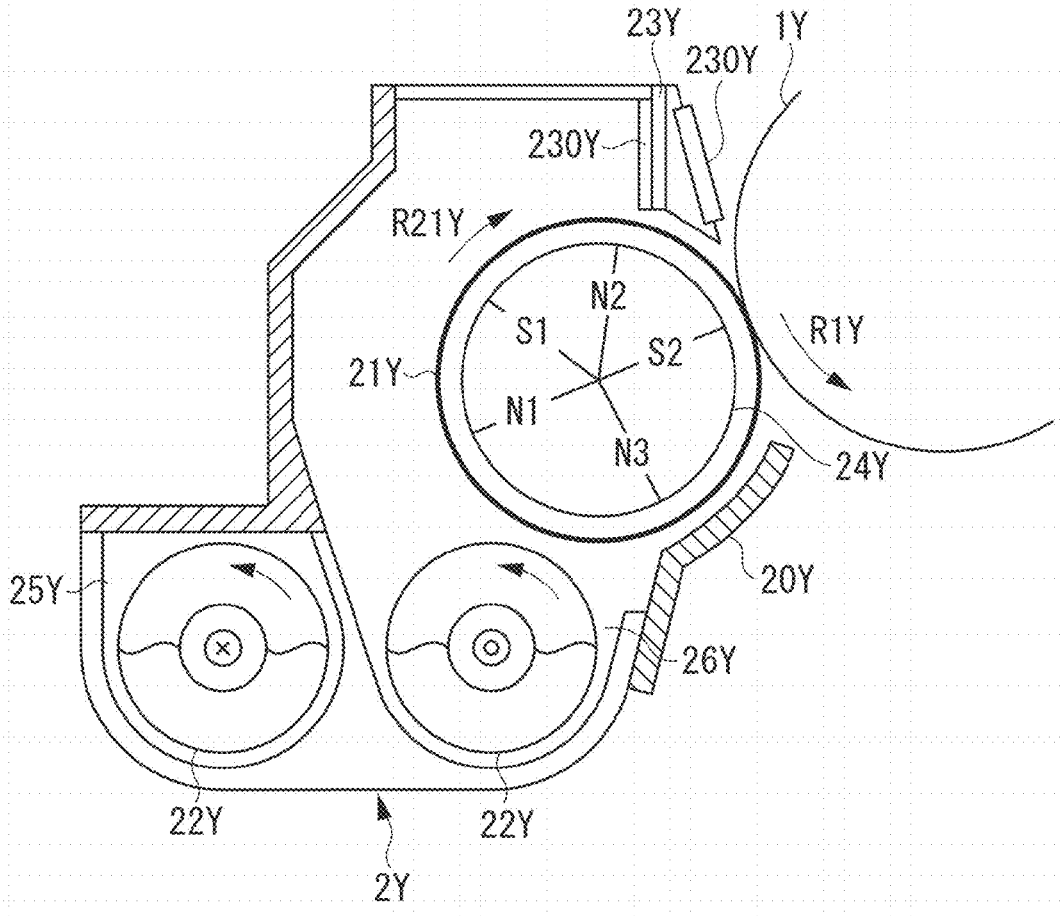
FIG. 17 is a schematic cross-sectional view of another example of the developing device according to the third embodiment.

A third embodiment of the present invention will be described using FIG. 13 or FIG. 17. An image forming apparatus 200 of the present embodiment is a tandem mode full-color image forming apparatus capable of forming full-color images at a maximum speed of 40 sheets/minute. Thus, the apparatus has image forming portions 10Y, 10M, 10C and 10K that form a toner image of four primary colors, yellow (Y), magenta (M), cyan (C) and black (K). In the present embodiment, a developer to be used is a two component developer composed of non-magnetic toner and a magnetic carrier.

These image forming portions 10Y to 10K form the image of a respectively corresponding color, and their configuration is almost the same. Thus, the image forming portion 10Y will be described in detail below, and the description for the other image forming portions 10 M to 10K is omitted.

The image forming portion 10Y includes a photosensitive drum 1Y, a primary charging device 5Y, a developing device 2Y, and a primary transfer device 31Y, and the like. The photosensitive drum 1Y including an OPC photosensitive layer has a diameter of 30 mm and forms an electrostatic latent image on its surface by laser beam from an exposure device (laser scanner) 6Y. A circumferential velocity is for example, 250 mm/s.

The primary charging device 5Y charges the surface of the photosensitive drum 1Y to a predetermined potential, e.g., −700 V to prepare the formation of the electrostatic latent image. The developing device 2Y develops the electrostatic latent image on the photosensitive drum 1Y to form a toner image.

Figure 14:
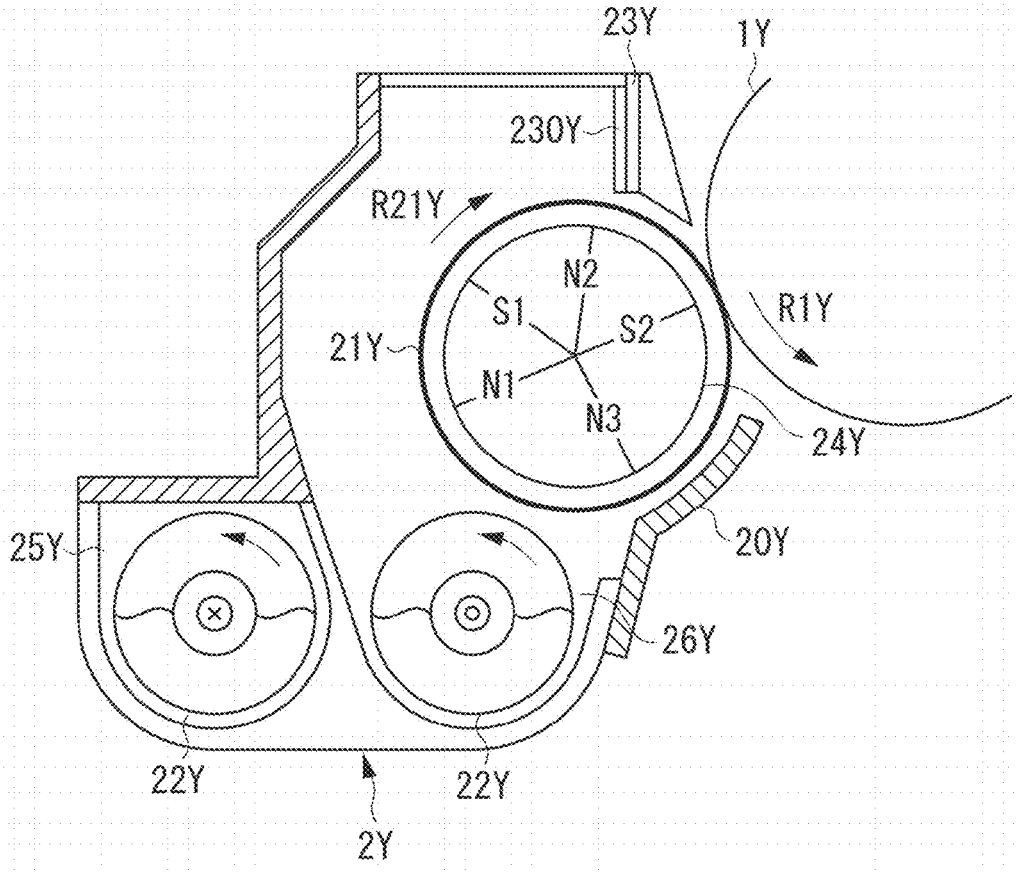
FIG. 14 is a schematic cross-sectional view of a developing device according to the third embodiment.

Such a developing device 2Y includes a developing sleeve 21Y as an developer bearing member, two feeding screws 22Y as developer stirring feeding members, a developing blade 23Y as a layer thickness regulating member, and the like in the developing container 20Y as shown in FIG. 14. The developing sleeve 21Y has a diameter of 20 mm and arranges a secured magnet 24Y inside thereof. The developing sleeve is also rotated and driven in a direction of an arrow R21Y by a driving unit not illustrated. The feeding screws 22Y are arranged in a stirring chamber 25Y and a developing chamber 26Y, respectively, and feed the developer in a mutually parallel and opposite direction. Both ends of the stirring chamber 25Y and the developing chamber 26Y are provided with communicating portions, and the developer is circulated between the stirring chamber 25Y and the developing chamber 26Y through these communicating portions.

In the developer stirred and fed in the stirring chamber 25Y and the developing chamber 26Y, the toner is charged in negative polarity and the carrier is charged in positive polarity. The developer is supported and fed on the developing sleeve 21Y by a magnetic force of the magnet 24Y. At that time, the developer supported on the developing sleeve 21Y is fed to the photosensitive drum 1 while its layer is regulated by the developing blade 23Y. A predetermined developing bias is applied between the developing sleeve 21Y and the photosensitive drum 1Y, and the electrostatic latent image on the photosensitive drum 1Y is developed by the toner. The developer left on the developing sleeve 21Y after the development is collected in the developing chamber 26Y.

The primary transfer device 31Y is a roller arranged at a position opposed to the photosensitive drum across the intermediate transfer belt 39. The toner image formed on the photosensitive drum 1Y is primarily transferred onto the intermediate transfer belt 39 by applying a predetermined primary transfer bias to this roller.

Subsequently in an order of M, C and K, the toner image of each color formed sequentially in the image forming portions 10Y to 10K is primarily transferred onto the intermediate transfer belt 39 and a full-color image is formed. The toner image formed on the intermediate transfer belt 39 is secondarily transferred onto a recording material S by a secondary transfer device 3. The secondary transfer device is composed of two rollers 32*e*, 32*i* made from an elastic body to which a secondary bias voltage is applied, the roller 32*i* in the secondary transfer device is pressed against the internal face of the intermediate transfer belt 39 and the roller 32*e* out of the secondary transfer device is pressed against the external face of the intermediate transfer belt 39.

Transfer residual toner on the photosensitive drum 1 and transfer residual toner on the intermediate transfer belt 39 are temporarily collected by a photosensitive drum cleaning device 41 and an intermediate transfer belt cleaning device 42, respectively, and discharged to a collection device not illustrated. The recording material S on which the toner image was transferred is fed to a fixing device 7, and the image is fixed on the recording material S by pressing and heating the recording material in the fixing device 7.

As described above, the developer of the present embodiment contains the magnetic carrier and the non-magnetic toner, and the toner is charged negatively. A mass per unit area of a developer layer formed on the developing sleeve 21Y is, for example, about 50 cm/cm$^2$.

The toner includes a color resin particle containing a binder resin, a coloring agent and if necessary other additives, and a color particle to which an external additive such as colloidal silica fine powder has been externally added. The binder resin is a polyester-based resin charged negatively, and has a volume average particle diameter of 7 μm. A carrier particle is composed of a material composed mainly of ferrite oxide, and is not limited to a production method. A weight average particle diameter is, for example, 40 μm and a volume electric resistance is, for example, $10^8$ Ω·cm.

Figure 15:
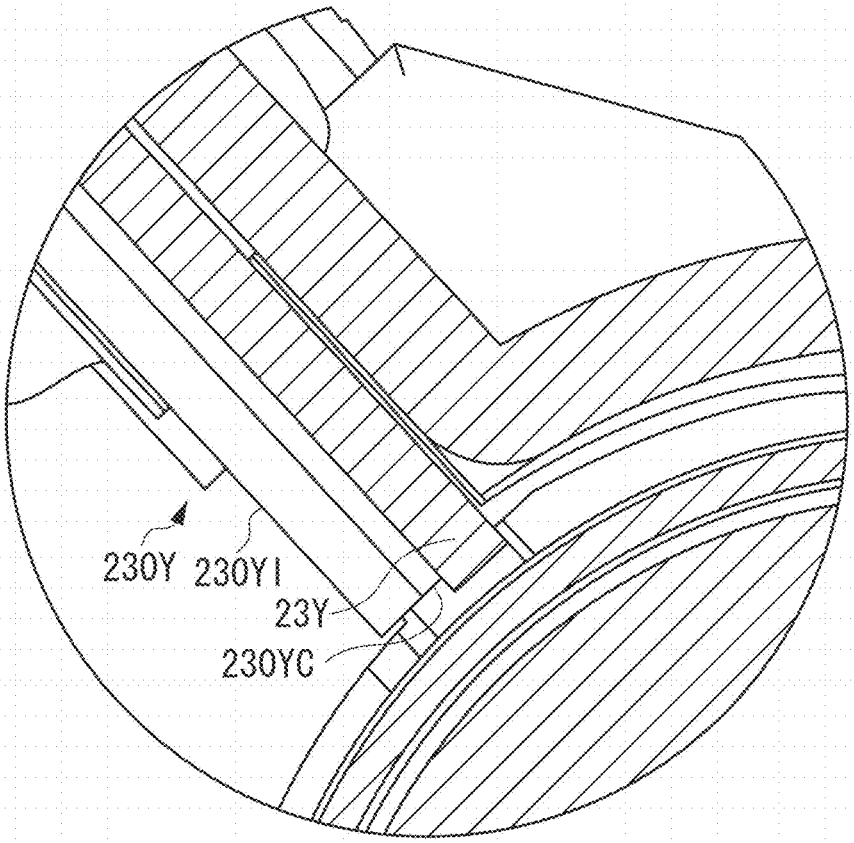
FIG. 15 is a magnified cross sectional view of a developing blade according to the third embodiment.

In the case of the present embodiment, as a part where the toner scatters in the apparatus, the developing blade 23Y as the layer thickness regulating member in the developing device 2Y is provided with the toner adhesion preventing member 230Y to reduce the toner scattering to an upstream part of the developing device. Such a toner adhesion preventing member 230Y is obtained by attaching the same insulating member 230YI as in the first embodiment to a magnetic metal plate 230YC as the conductive member with the adhesive, as shown in FIG. 15. The toner adhesion preventing member is secured to a backside of the developing blade 23Y (side on which the developer is fed from the developing sleeve 21Y) so that the free surface of the insulating member 230YI faces toward an internal face of the developing container 20Y.

Figure 16:
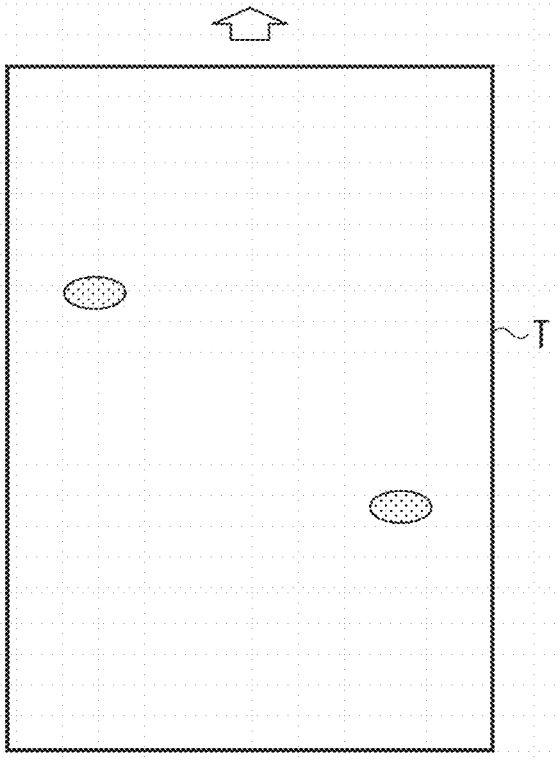
FIG. 16 is a view showing one example where an output image was contaminated with a mass of toner.

This can reduce caking of the toner onto the backside of the developing blade 23Y. That is, when the toner is caked and deposited on the backside of the developing blade 23Y to increase a deposit layer, this deposited toner sometimes drops at a time. Sometimes, the toner scatters in a part where there is an airspace in the developing container 20Y, e.g., from the airspace between the opening of the developing container 20Y and the developing sleeve 21Y and from the airspace in a sealed part of the developing sleeve at an end. Also, such a toner mass sometimes drops, and an output image on the intermediate transfer belt 39 is stained with this toner, as shown in FIG. 16. In the present embodiment, the backside of the developing blade 23Y is provided with the toner adhesion preventing member 230Y. Thus, such an occurrence can be reduced. This is the same in the other image forming portions.

As described above, the developer of the present embodiment is the two component type, and the toner has no magnetic force to the developing sleeve 21Y. Thus, the present embodiment is effective for the case of frequent toner scattering at high temperature and high humidity at which the charge amount of the toner is reduced.

The toner adhesion preventing member 230Y as described above may be provided on an outside of a portion that covers the developing sleeve 21Y in the developing container 20Y, as a part where the toner scatters in the apparatus. That is, the toner adhesion preventing member 230Y is provided on the portion above the opening of the developing container 20Y and covering the developing sleeve 21Y. This can prevent the toner from scattering upward of the developing devise 2Y.

Example 3

Subsequently, results of an experiment in which the configuration of the present embodiment was actually applied will be described. In the experiment, the one obtained by attaching a porous insulating member (foam member, part number: EE-1010) to a magnetic metal plate as the conductive member with the double stick tape. The magnetic metal plate has a rectangular shape having a width of 20 mm, a length of 320 mm and a thickness of 1 mm. The insulating member has a width of 20 mm, a length of 320 mm and a thickness of 5 mm. The double stick tape has a thickness of 0.5 mm. The results of this experiment are shown as Example 3 in aforementioned Table 3. In Example 3, the toner adhesion to the backside of the developing blade was able to be widely reduced by providing the backside of the developing blade with the toner adhesion preventing member.

Conventional Example 2

Here, Conventional Example 2 in Table 3 will be described. Conventional Example 2 is an image forming apparatus having the same configuration as in the third embodiment, and any part of the image forming apparatus was provided with no toner adhesion preventing member. In the case of such Conventional Example 2, the toner scatters to adhere to various portions in the image forming apparatus. Thus, the maintenance frequency is reduced (e.g., the cleaning is required every about 50,000 sheets of image output), and the maintenance cost is reduced. Also in the case of Conventional Example 2, the toner left away from the carrier on the developing sleeve scatters between the developing sleeve and the photosensitive drum in the developing step. This was noticeable particularly when an alternating bias was applied.

On the other hand, in Example 3, the case where the adhered toner with low charge amount drops outside of the developing device to stain the output image can be reduced. Thus, the maintenance frequency and the maintenance cost are reduced compared with Conventional Example 2.

Figure 18:
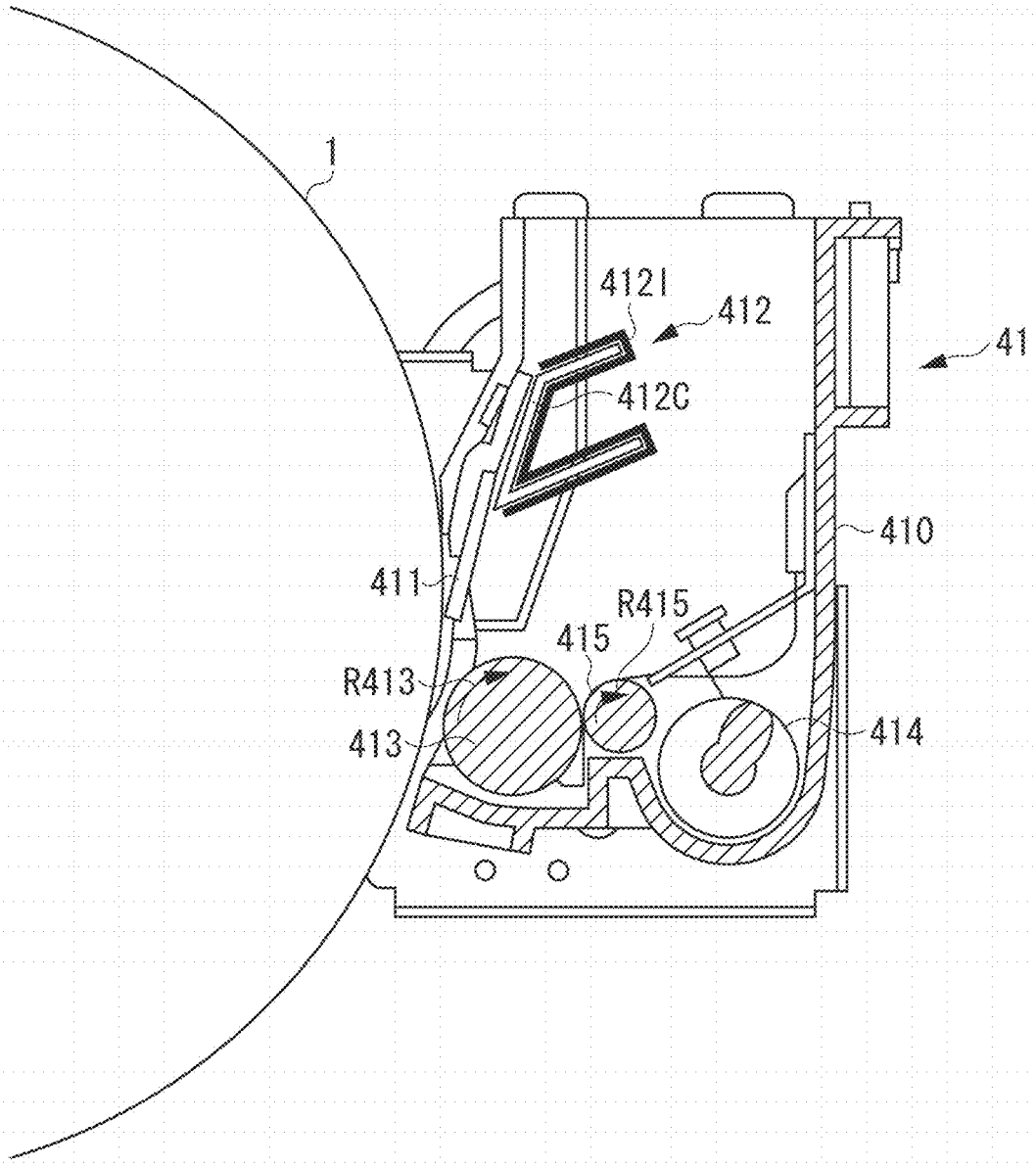
FIG. 18 is a schematic cross-sectional view of a cleaning device according to a fourth embodiment of the present invention.
Figure 19:
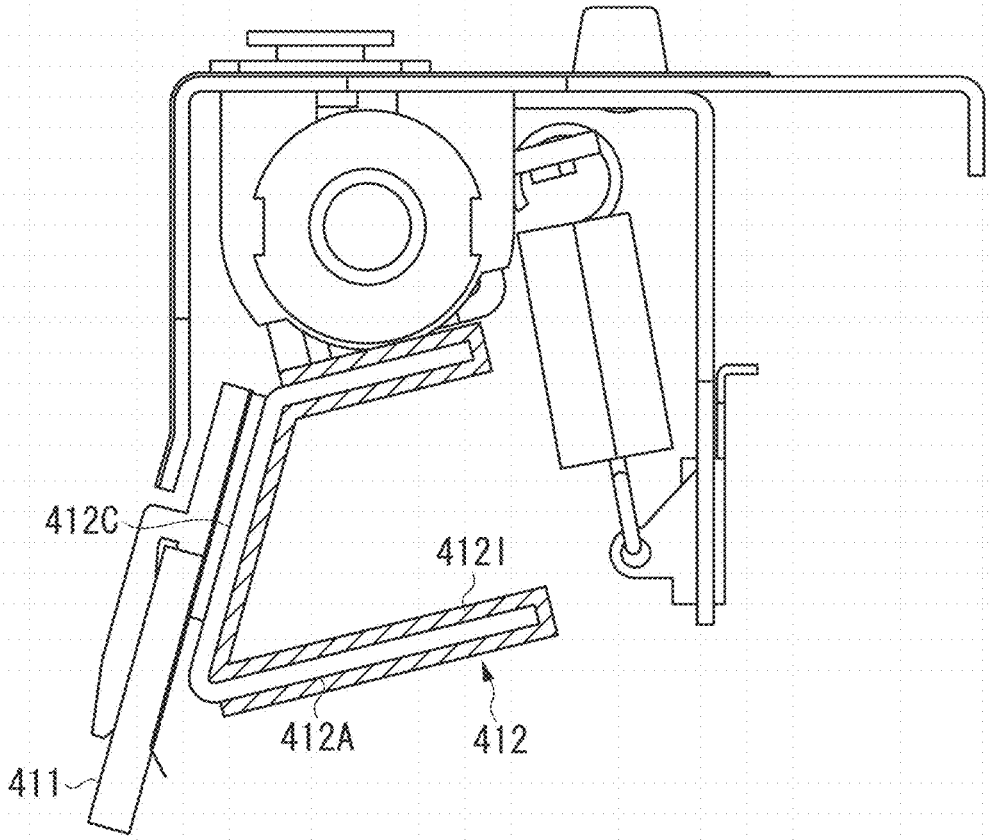
FIG. 19 is a magnified cross sectional view of a cleaning blade support member of the same.

A fourth embodiment of the present invention will be described using FIG. 18 and FIG. 19. In the present embodiment, as the part where the toner scatters in the apparatus, an inside of the photosensitive drum cleaning device 41 as the cleaning unit, particularly a part supporting a cleaning blade 411 is provided with the toner adhesion preventing member 412. The other basic configuration of the image forming apparatus is the same as in the first embodiment described above. Thus, points that are different from those in the first embodiment will be mainly described.

The cleaning blade 411 is supported by a metallic cleaning blade support member 412C, and the conductive member of the toner adhesion preventing member 412 is the cleaning blade support member 412C. In other words, the cleaning blade support member 412C is a constituent element that composes the image forming portion and works as the conductive member. The cleaning blade support member 412C is made by bending a platy member and has a shape as shown in the figure. The same insulating member 412I as in the first embodiment is attached with the double stick tape 412A so as to cover the surface (backside except for a face supporting the cleaning blade 411) of this cleaning blade support member 412C (FIG. 19). The free surface of the insulating member 4211 also covers the surface of the cleaning blade support member 412C. Also, the cleaning blade support member 412C is connected to the ground, and its surface potential is kept at 0 V.

In the case of the present embodiment, such a configuration can prevent the residual toner from accumulating on and the toner from scattering from an upper face in the photosensitive drum cleaning device 41, as well as the toner from staining the output image. That is, the residual toner on the photosensitive drum 1 is removed by the cleaning blade 411, and sent to the outside of the photosensitive drum cleaning device 41 by a feeding member 414 through a permanent magnet 413. In this way, the toner scatters inside the photosensitive drum cleaning device 41 while the toner is sent to the outside of the photosensitive drum cleaning device 41. This scattered toner adheres to an upper face of the photosensitive drum cleaning device 41, and when the number of image formation sheets is increased, the toner is accumulated here. As a result, for example, the toner adhered and accumulated on the backside of the cleaning blade support member 412C drops at a time onto a permanent magnet roller 413 and a feeding member 414 that stably supply a toner amount on the photosensitive drum 1. The toner likely scatters from the end of the photosensitive drum cleaning device 41 onto the intermediate transfer belt 39, and further likely stains the output image. In the present embodiment, the cleaning blade support member 412C is covered with the insulating member 412I as described above. Thus, the scattering toner is difficult to accumulate on the cleaning blade support member 412C, and the toner can be prevented from scattering and staining the output image.

Example 4

Subsequently, results of an experiment in which the configuration of the present embodiment was actually applied will be described. In the experiment, the one obtained by attaching a porous insulating member (foam member, part number: No. 681) 412I to the surface of the cleaning blade support member 412C as the conductive member with the double stick tape 412A was used as the toner adhesion preventing member. The cleaning blade support member 412C is a non-magnetic metal plate obtained by bending a rectangular shape having a width of 340 mm, a length of 60 mm and a thickness of 1 mm. The insulating member 412I has a width of 340 mm, a length of 58 mm and a thickness of 2 mm. The double stick tape 412A has a thickness of 0.5 mm. The results of this experiment are shown as Example 4 in aforementioned Table 3.

In Example 4, the adhesion of the toner onto the backside of the cleaning blade support member 412C was able to be widely reduced by doubling the cleaning blade support member 412C with the toner adhesion preventing member 412. In Conventional Example 1, the toner adhered and accumulated onto the backside of the cleaning blade support member dropped at a time onto the permanent magnet and the feeding member, and scattered from the end of the photosensitive drum cleaning device onto the intermediate transfer belt, and further stained the output image. On the other hand, in Example 4, the scattering toner was extremely reduced, and consequently the maintenance frequency and the maintenance cost were able to be reduced compared with Conventional Example 1.

Figure 20:
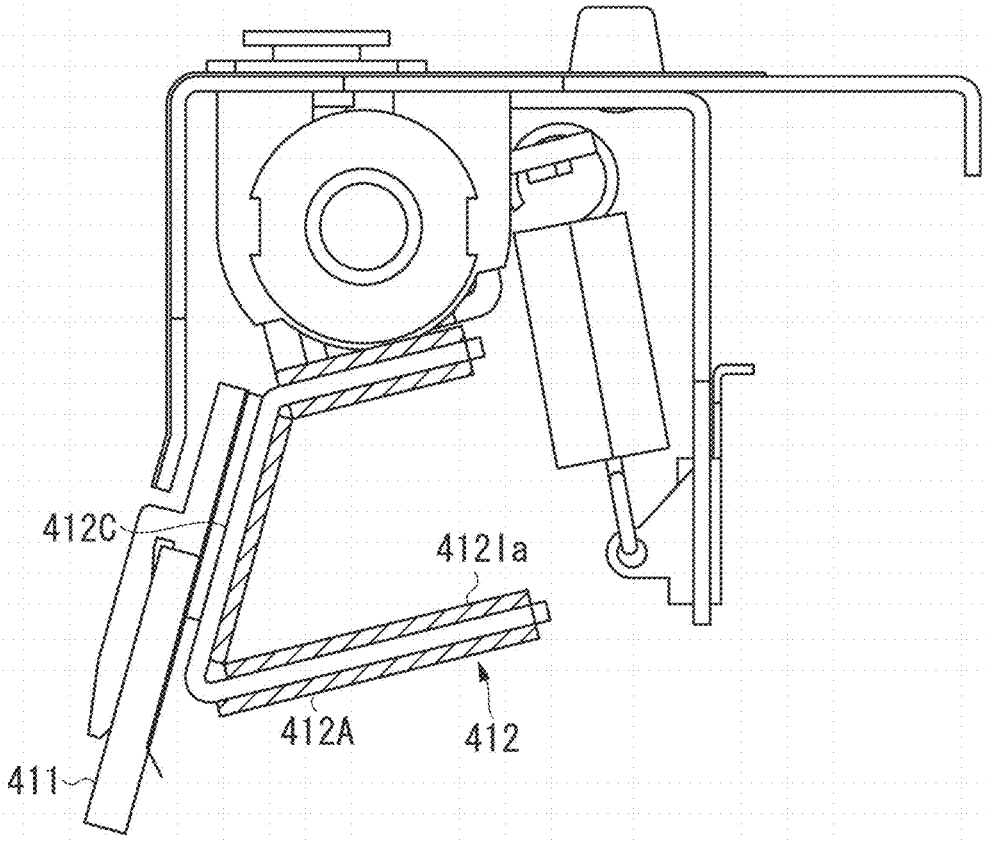
FIG. 20 is a magnified cross sectional view of a cleaning blade support member of a cleaning device according to a fifth embodiment of the present invention.

A fifth embodiment of the present invention will be described using FIG. 20. In the present embodiment, a part that supports the cleaning blade 411 in the photosensitive drum cleaning device 41 is provided with the toner adhesion preventing member 412 as is the case with the fourth embodiment. That is, the same insulating member 412Ia as in the first embodiment is attached with the double stick tape 412A so as to cover the surface of the cleaning blade support member 412C (backside, except for the face supporting the cleaning blade 411). In this regard however, differently from the fourth embodiment, the cleaning blade support member 412C is provided with the divided insulating member 412Ia. This can keep adhesiveness of the insulating member and can keep a capacity to prevent the adhesion and scattering of the toner for a long period of time even when the conductive member is not a flat plate and is composed of a complicated curved face. The other configurations and functions are the same as those in the fourth embodiment as described above.

Example 5

Subsequently, results of an experiment in which the configuration of the present embodiment was actually applied will be described. In the experiment, the one obtained by dividing and attaching a porous insulating member (foam member, part number: No. 681) 412Ia to the surface of the cleaning blade support member 412C as the conductive member with the double stick tape 412A was used as the toner adhesion preventing member. Each material is the same as that in the fourth embodiment. The results of this experiment are shown as Example 5 in aforementioned Table 3. In the case of this Example, the maintenance frequency was also reduced and the maintenance cost was also reduced.

A sixth embodiment of the present invention will be described using FIG. 21 and FIG. 22. In the present embodiment, as a site where the toner scatters in the apparatus, a side wall part 20SY (vicinity of an opening) that is an inner side face of the opening 27Y of the developing container 20Y in the developing device 2Y and is opposed to the developing sleeve 21Y is provided with the toner adhesion preventing member 290Y. The other basic configuration of the image forming apparatus is the same as in the third embodiment described above. Thus, points that are different from those in the third embodiment will be mainly described below.

Figure 22:
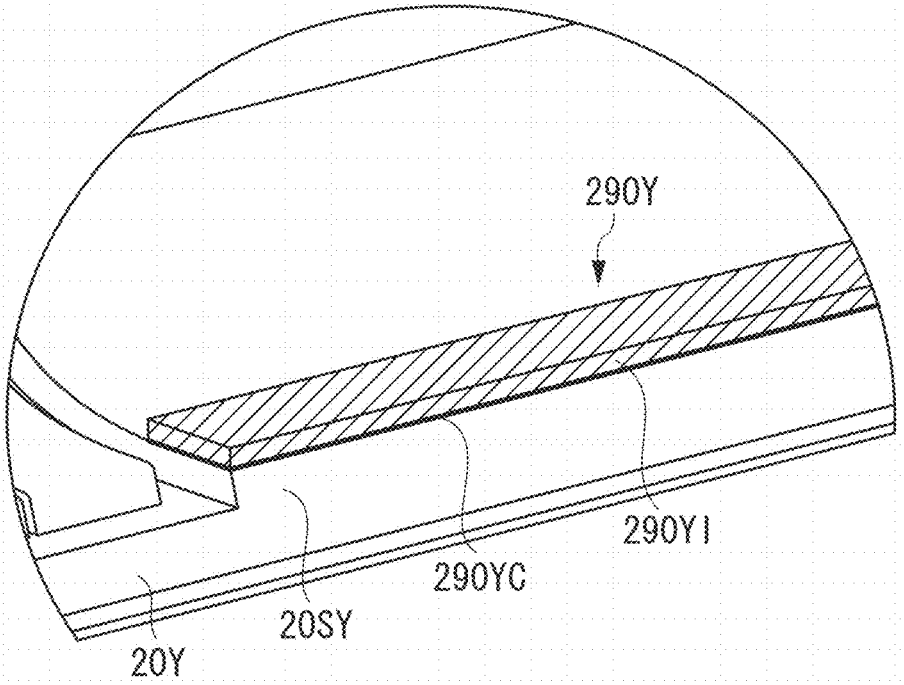
FIG. 22 is a magnified perspective view of a toner adhesion preventing member according to the sixth embodiment.

In the toner adhesion preventing member 209Y, the same insulating member 290YI as in the first embodiment is attached to a magnetic metal plate 290Y as the conductive member with the adhesive, as shown in FIG. 22. The toner adhesion preventing member is secured to the side wall part 20SY of the developing container 20Y so that the free surface of the insulating member 209YI is faced to the side of the developing sleeve 21Y.

Figure 21:
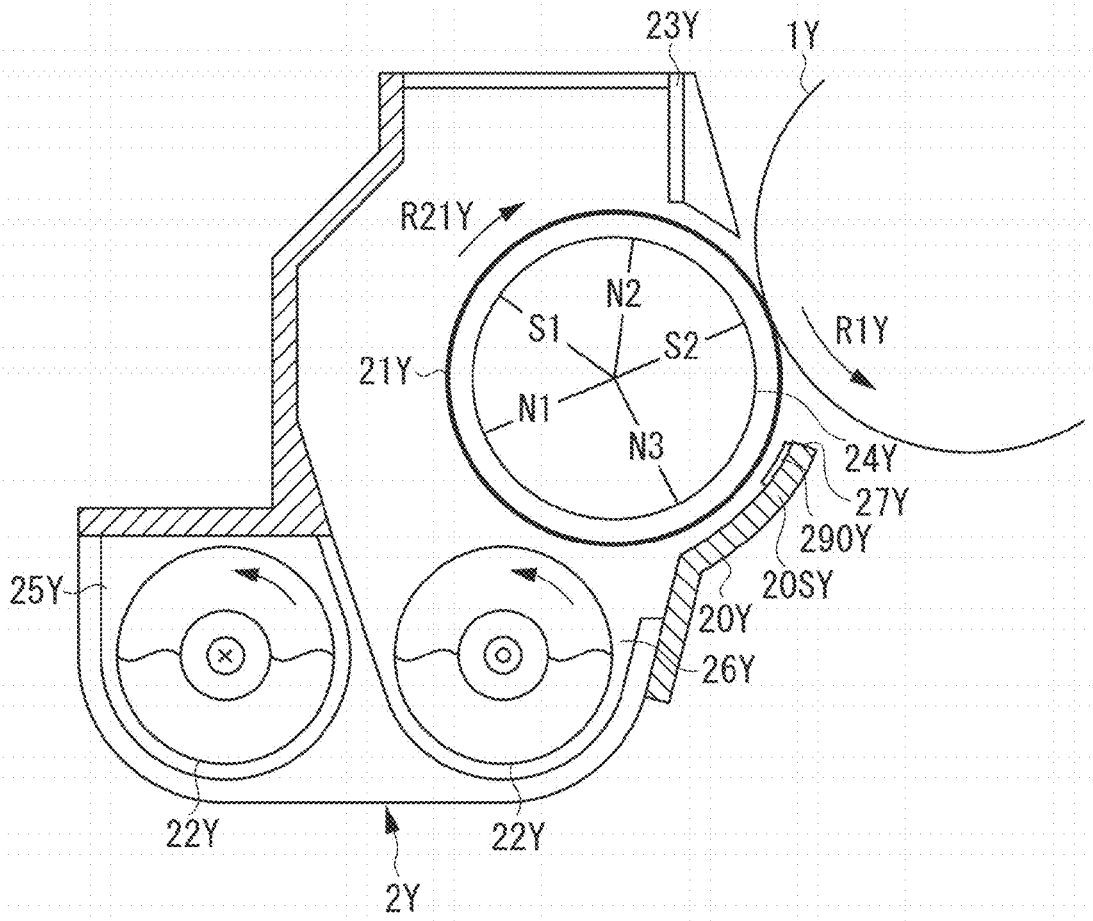
FIG. 21 is a schematic cross-sectional view of a developing device according to a sixth embodiment of the present invention.

In FIG. 21, the toner adhesion preventing member 290Y is placed 2 mm apart from the surface of the developing sleeve 21Y as a partner member, and is provided on an upstream side in the rotation direction R21Y of the developing sleeve 21Y rather than near an uptake pole N3 of the magnet 24Y. This avoids bringing the developer into the contact with the toner adhesion preventing member 290Y. Thus, the amount of the scattering toner can be reduced without producing image unevenness.

In the present embodiment, the toner adhesion preventing member 290Y is provided closely to a part between a development pole S2 and the uptake pole N3, where developer brushes are compressed. Thus, the toner adhesion preventing member 290Y can be placed more closely to the developing sleeve 21Y than in the case of providing it at a position opposed to a magnetic pole. The image forming part for Y was set forth in the above description, and the description is the same for the other image forming portions.

Also in the present embodiment, the side wall part 20SY (vicinity of the opening) opposed to the developing sleeve 21Y is provided with the toner adhesion preventing member 290Y, but the configuration is not limited thereto. The site to which the toner is supposed to scatter in the developing device can appropriately be provided with the toner adhesion preventing member 290Y. For example, the porous insulating member of the present invention may be attached to an end of the developing sleeve or a container surface opposed to the end of the developing sleeve in order to prevent the toner from scattering from the end of the developing sleeve. Also in this case, the free surface of the porous insulating member is attached and used so that it does not come into contact with the member opposed thereto.

Example 6

Subsequently, results of an experiment in which the configuration of the present embodiment was actually applied will be described. In the experiment, the one obtained by attaching a porous insulating member (foam member, part number: EE-1010) to a magnetic metal plate as the conductive member with the double stick tape was used as the toner adhesion preventing member. The magnetic metal plate has a width of 20 mm, a length of 320 mm and a thickness of 1 mm. The insulating member has a width of 20 mm, a length of 320 mm and a thickness of 5 mm. The double stick tape has a thickness of 0.5 mm. The results of this experiment are shown as Example 6 in aforementioned Table 3.

In Example 6, the amount of the scattering toner was able to be reduced to about ⅕ or less compared with Conventional Example 2 in which the toner adhesion preventing member is not provided. Also the maintenance frequency was reduced and the maintenance cost was reduced compared with Conventional Example 2. Compared with Conventional Example 3 in Table 3, an apparatus cost worth of omitting a high voltage power supply for applying high voltage to the toner adhesion preventing member was reduced.

Conventional Example 3

Here, Conventional Example 3 in Table 3 will be described. In Conventional Example 3, a non-magnetic metal platy member having a thickness of 0.5 mm in place of the toner adhesion preventing member was placed 2 mm apart from the surface of the developing sleeve 21Y in the same position as in the sixth embodiment in the image forming apparatus having the same configuration as in the sixth embodiment. Then, a direct current at −1000 V was applied to this member from the high voltage power supply not illustrated. In the case of such Conventional Example 3, although there is an effect of preventing the toner scattering to some extent (cleaning is required every about 50,000 sheets of output images), the apparatus cost worth of the high voltage power supply was high.

Figure 23:
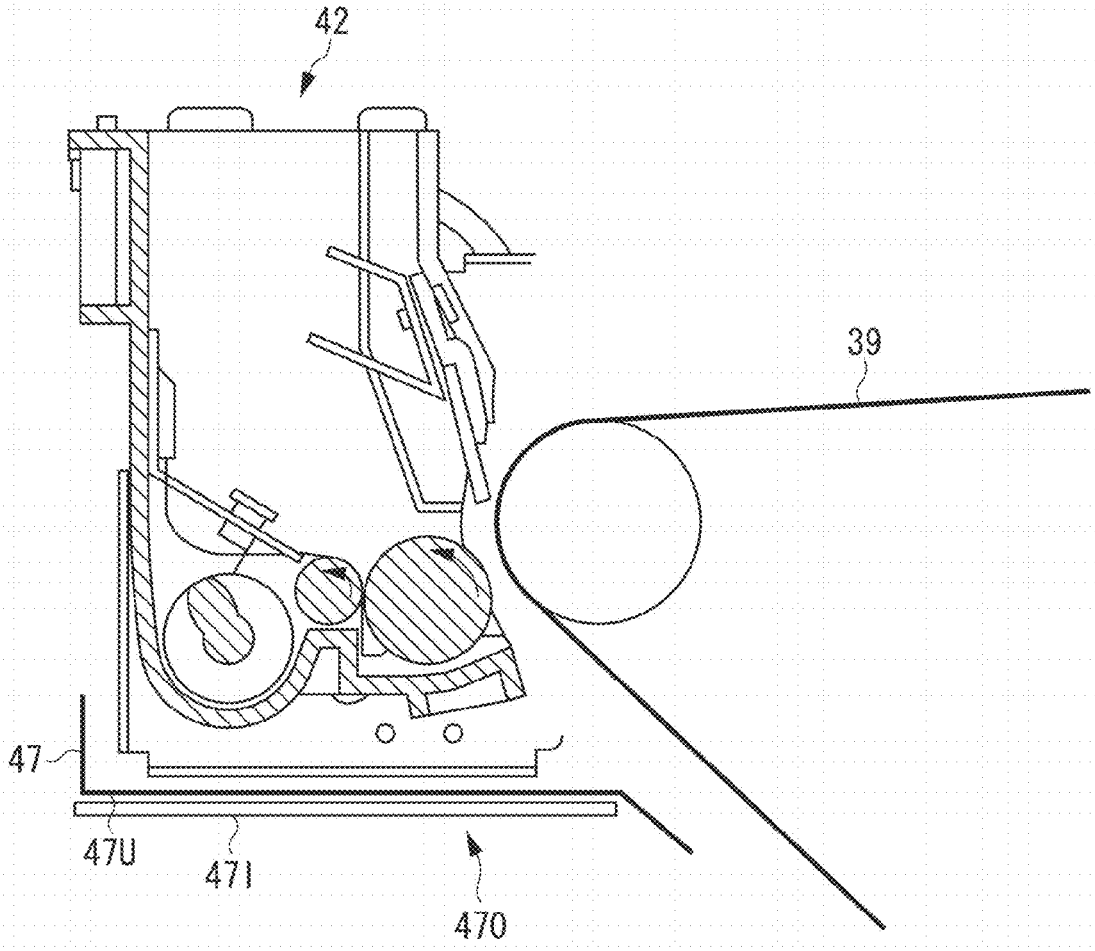
FIG. 23 is a schematic cross-sectional view of a cleaning member according to a seventh embodiment of the present invention.
Figure 24:
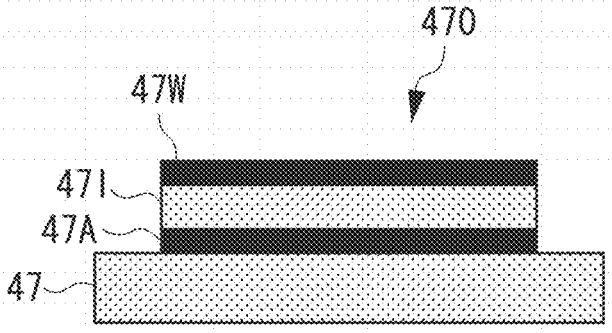
FIG. 24 is a schematic view of a toner adhesion preventing member provided with a waterproof layer according to the seventh embodiment.

A seventh embodiment of the present invention will be described using FIG. 23 and FIG. 24. In the present embodiment, as a site where the toner scatters in the apparatus, a side surface 47U on a side of a pathway where the recording material after the secondary transfer is fed on a platy support member 47 that supports the intermediate transfer belt cleaning device 42 is provided with the same insulating member 47I as in the first embodiment. That is, a downstream of the rotation direction (movement direction) of the intermediate transfer belt 39 in the secondary transfer device 3 as the transfer unit is provided with the toner adhesion preventing member 470. The other basic configuration of the image forming apparatus is the same as in the first embodiment described above. Thus, points that are different from those in the first embodiment will be mainly described below.

In the present embodiment, the support member 47 is a metallic platy member connected to the ground and becomes the conductive member having the constant potential (0 V). In other words, the support member 47 is a constitutive element that composes the image forming portion and works as the conductive member. The insulating member 47I is attached to the support member 47 to form the toner adhesion preventing member 470. Also in the present embodiment, the free surface (lower surface in FIG. 23) of the insulating member 47I has a waterproof layer (water guard layer) 47W as a coating layer that has a higher smoothness than the surface of the insulating member 47I, as shown in FIG. 24. That is, in the toner adhesion preventing member 470 as shown in FIG. 24, the insulating member 47I is attached to the metallic support member 47 with the adhesive 47A such as an acryl resin, and further the surface of the insulating member 47I is covered with the waterproof layer 47W. This waterproof layer is formed by extruding melted polyethylene glycol or polypropylene glycol on an insulation material, e.g., an acrylic sticky layer. The waterproof later may be formed by a laminate system of a film. Particles (negatively charged toner in the present embodiment) charged in the same polarity as that of particles, the adhesion of which is prevented are adhered onto the surface of this water proof layer 47W.

In the case of the present embodiment, a downside of the intermediate transfer belt cleaning device 42 is provided with the toner adhesion preventing member 470. Thus, the toner that scatters from the intermediate transfer belt 39 is unlikely to scatter to an opposite side of the intermediate transfer belt 39 beyond the intermediate transfer belt cleaning device 42. Also the scattering toner becomes difficult to adhere to the support member 47 on the downside of the intermediate transfer belt cleaning device 42. Thus, the toner is prevented from staining the image on the recording material fed on the downside of the intermediate transfer belt cleaning device 42. That is, it is likely that the toner that scatters from the intermediate transfer belt 39 adheres to and accumulates on the side surface 47U of the support member 47 and this accumulated toner drops to stain the output image. On the other hand, in the present embodiment, the scattering toner is difficult to adhere to the side surface 47U and thus can be prevented from staining the output image as above.

Also in the case of the present embodiment, the surface of the toner adhesion preventing member 470 is provided with the waterproof layer 47W. Thus, a surface property is good, and the toner adhesion preventing member 470 is easily cleaned because the service engineer can just wipe it at maintenance. Therefore, the quality of maintenance by the service engineer is enhanced.

Example 7

Subsequently, results of an experiment in which the configuration of the present embodiment was actually applied will be described. In the experiment, the one obtained by attaching a porous insulating member (foam member, part number: SA-612) 47I to the surface of the support member as the conductive member with the double stick tape was used as the toner adhesion preventing member. A layer thickness of the insulating member 47I is 5 mm. A layer thickness of a waterproof layer (formed by extruding melted polyethylene glycol on an acrylic sticky layer) 47W is about 100 μm to 500 μm. The surface potential was −1600 V when 0.01 g of the negatively charged toner was adhered onto the surface of this waterproof layer 47W. The results of this experiment are shown as Example 7 in Table 3. In Example 7, the surface potential was −1800 V, and thus it was found that the negatively charged toner was not attracted any more. Also the maintenance frequency and the maintenance cost were reduced compared with Conventional Example 1.

Figure 25:
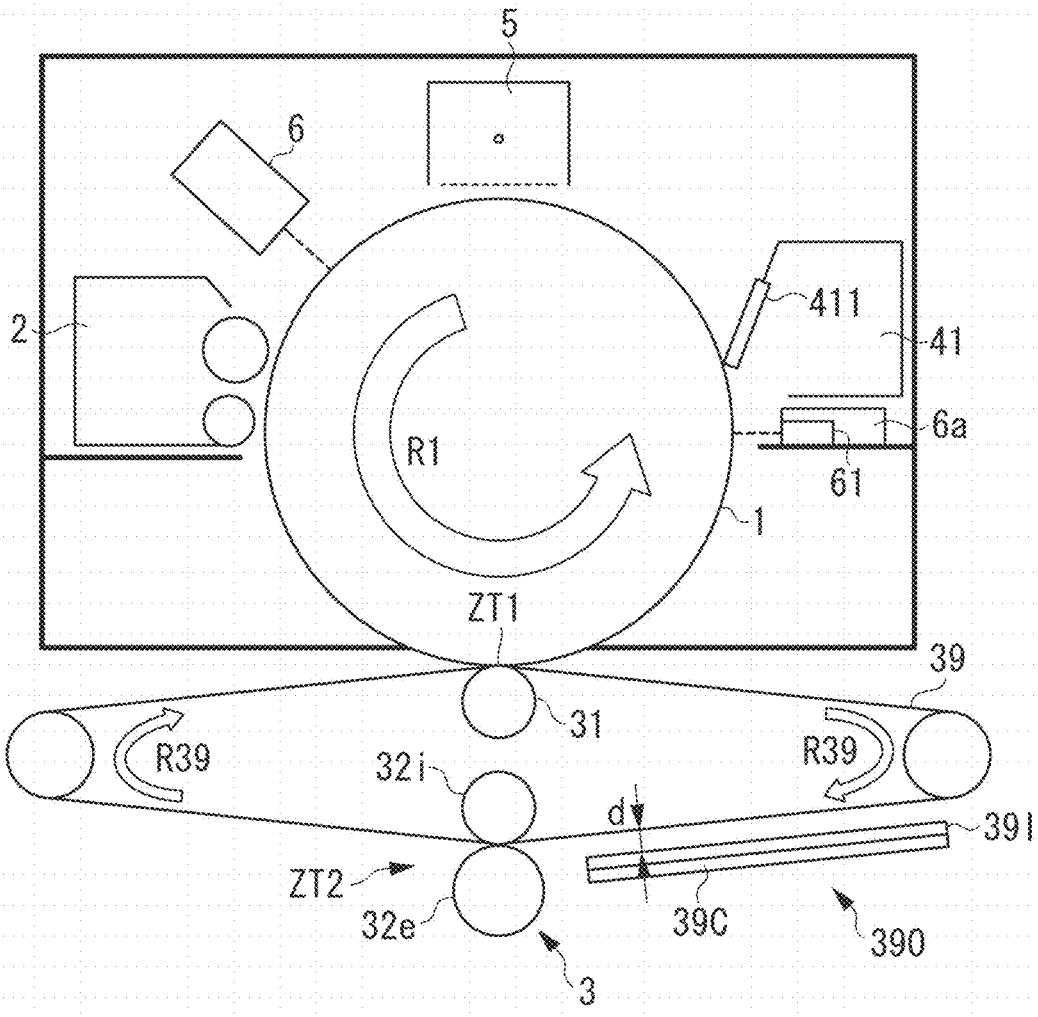
FIG. 25 is a schematic cross-sectional view of an image forming apparatus according to an eighth embodiment of the present invention.

An eighth embodiment of the present invention will be described using FIG. 25. In the present embodiment, as a site where the toner scatters in the apparatus, a downward of the intermediate transfer belt 39 is provided with the same toner adhesion preventing member 390 as in the first embodiment. The other basic configuration of the image forming apparatus is the same as in the first embodiment described above. Thus, points that are different from those in the first embodiment will be mainly described below.

The toner adhesion preventing member 390 is formed by attaching an insulating member 391 to a platy member 39C as the conductive member, arranged downward of the intermediate transfer belt 39. The free surface of the insulating member 391 is opposed to a portion of an image area where the toner image is fed from the intermediate transfer belt 39. A distance d between the free surface and the surface of the intermediate transfer belt 39 as the partner member is 1 mm or more and 10 mm or less (2 mm in the present embodiment).

In the case of the present embodiment, the toner that scatters from the intermediate transfer belt 39 and the like becomes difficult to adhere to the platy member 39C. Thus, this toner can be prevented from accumulating on the platy member 39C, and the accumulated toner can be prevented from dropping to stain the output image.

Example 8

Subsequently, results of an experiment in which the configuration of the present embodiment was actually applied will be described. In the experiment, the one obtained by attaching an insulating member 391 (part number: E-4382 in Table 1) having a thickness of 1 mm to the platy member 39C with the adhesive (double stick tape) having a thickness of 0.5 mm was used as the toner adhesion preventing member 390. A distance d between the toner adhesion preventing member 390 and the intermediate transfer belt 39 was 2 mm. The results of this experiment are shown as Example 8 in Table 3. In Example 8, the scattering of the toner was able to be reduced, and the maintenance frequency and the maintenance cost were also able to be reduced compared with Conventional Example 1.

Figure 26:
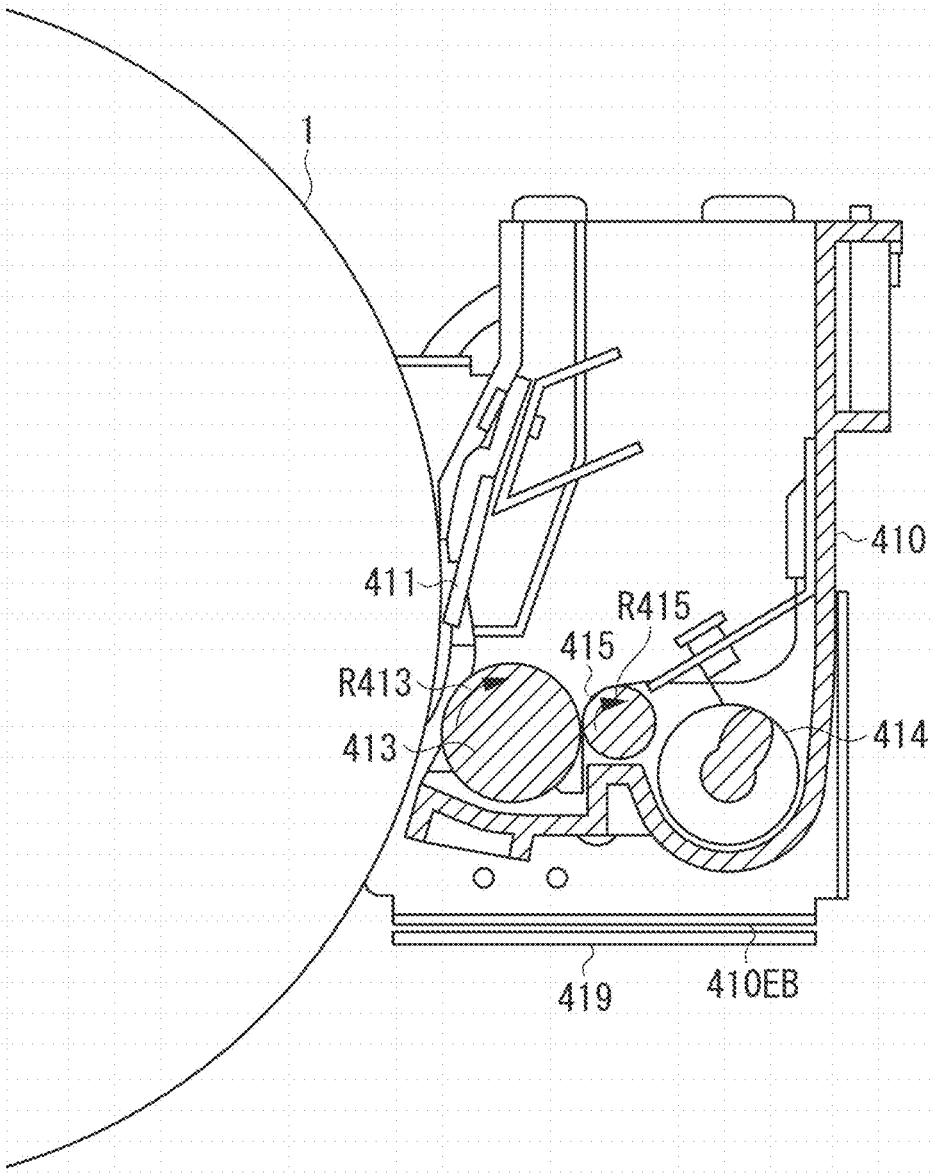
FIG. 26 is a schematic cross-sectional view of a cleaning device according to a ninth embodiment of the present invention.

A ninth embodiment of the present invention will be described using FIG. 26. In the present embodiment, as a site where the toner scatters in the apparatus, an external bottom part 410EB of the cleaning container 410 of the photosensitive drum cleaning device 41 is provided with the toner adhesion preventing member 419. The other basic configuration of the image forming apparatus is the same as in the first embodiment described above. Thus, points that are different from those in the first embodiment will be mainly described below.

The toner adhesion preventing member 419 is formed by attaching the insulating member to the conductive member as is the case with the first embodiment, and secured onto an underside of the external bottom part 410EB of the photosensitive drum cleaning device 41. The free surface of the insulating member is opposed to the surface of the intermediate transfer belt 39. The toner adhesion preventing member 419 is arranged downstream in the rotation direction (movement direction) of the photosensitive drum 1 as the image bearing member that moves with supporting the toner image in the primary transfer device 31 (see FIG. 1) as the transfer unit.

A photosensitive drum cleaning device 41 is arranged downstream in the rotation direction of the photosensitive drum 1 in the primary transfer section. The charged toner generated immediately after the transfer easily scatters to various portions in the apparatus. Thus, it is likely that the toner that scatters from the intermediate transfer belt 39 and the like is accumulated on the external bottom part 410EB and the accumulated toner drops to stain the output image. In the present embodiment, the toner adhesion preventing member 419 is provided so as to cover the underside of this external bottom part 410EB. Thus, the scattering toner becomes difficult to adhere to the external bottom part 410EB, and the toner can be prevented from staining the output image.

Example 9

Subsequently, results of an experiment in which the configuration of the present embodiment was actually applied will be described. In the experiment, the one obtained by attaching the insulating member (part number: E-4382 in Table 1) having a thickness of 1 mm to the conductive member with the adhesive (double stick tape) having a thickness of 0.5 mm was used as the toner adhesion preventing member 419. The results of this experiment are shown as Example 9 in Table 3. In Example 9, the toner contamination was reduced, and consequently the maintenance frequency and the maintenance cost were also able to be reduced compared with Conventional Example 1.

Figure 27:
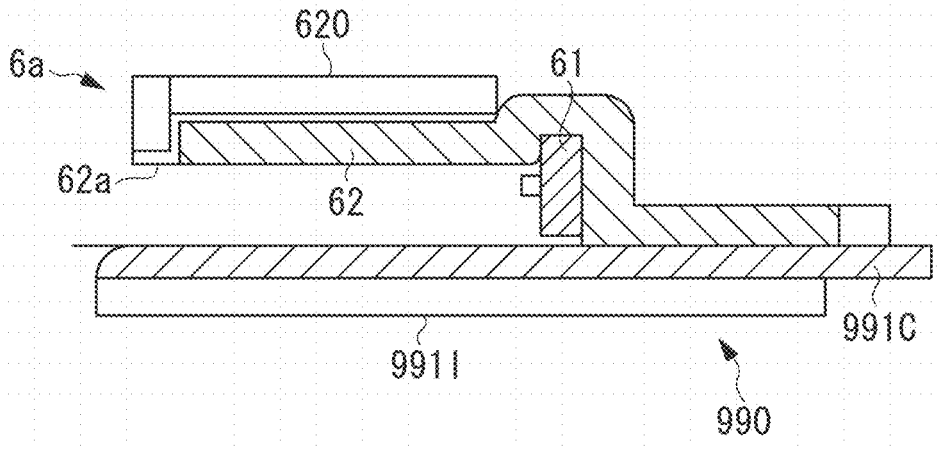
FIG. 27 is a schematic cross-sectional view of a preexposure device according to a tenth embodiment of the present invention.

A tenth embodiment of the present invention will be described using FIG. 27. In the present embodiment, as a site where the toner scatters in the apparatus, a vicinity of an opening 62*a* of a duct 62 that guides light of an LED array 61 that composes a preexposure device 6*a* is provided with the toner adhesion preventing member 620. The other basic configuration of the image forming apparatus is the same as in the first embodiment described above. Thus, points that are different from those in the first embodiment will be mainly described below.

The preexposure device 6*a* as an exposure unit includes the LED array 61 as a light emitting portion that emits exposure light and the duct 62 that guides the exposure light emitted from the LED array 61 to the photosensitive drum 1. The preexposure device 6*a* is used as preexposure used for returning the potential on the photosensitive drum 1 (see FIG. 5) to the constant. Also as shown in FIG. 5, by arranging downside of the photosensitive drum cleaning device 41, the preexposure device 6*a* can also be used as cleaning preexposure that cancels the potential on the photosensitive drum 1 before the cleaning in order to help a cleaning property of the photosensitive drum cleaning device 41.

In either case, the toner adhesion preventing member 620 is formed by attaching the insulating member to the conductive member as is the case with the first embodiment, and secured to the side of the photosensitive drum cleaning device 41 in the vicinity of the opening 62*a* of the duct 62. The toner adhesion preventing member 990 attaching the insulating member 991I to the joining member 991C is arranged on the downside of the preexposure device 6*a* in a prescribed manner as is the case with the aforementioned first embodiment. A color of the insulating member of the toner adhesion preventing member 620, 990 is desirably black. This makes the stain not prominent and prevents flare due to reflection upon exposure.

In the case of the present embodiment, the toner adhesion preventing member 620 is provided as described above. Thus, the toner that scatters from the intermediate transfer belt 39 becomes difficult to adhere to the LED array 61. If the LED array 61 is stained, a light amount is reduced and it is likely that the static charge on the photosensitive drum 1 is not removed sufficiently. However in the present embodiment, the scattering toner is difficult to adhere to the LED array 61. Thus, reduction of a capacity to remove the electricity can be prevented.

A frequency of the cleaning by the service engineer can be reduced without staining the joining member 991C arranged on the downside of the preexposure device 6*a*, as well as the exposure that subserves a cleaning performance can always be kept. Thus, the cleaning performance is not reduced and an attendance frequency of the service engineer due to the reduction of the cleaning performance can also be reduced.

The present embodiment can also be applied to an exposure device (exposure unit) for forming the electrostatic latent image on the photosensitive drum, in addition to the preexposure device. For example, the present embodiment can be applied similarly to the exposure device that is arranged in a circumference of the photosensitive drum and depicts the electrostatic latent image using the exposure light by the LED array. Also in such a case, the scattering toner can be prevented from adhering to the LED array by providing the vicinity of the opening of the duct for guiding the exposure light of the LED array to the photosensitive drum with the toner adhesion preventing member as described above. If the LED array is stained, the light amount is reduced and the image unevenness and the like likely occur. However, the occurrence of such an image unevenness can be prevented by providing the toner adhesive prevention member as described above.

Example 10

Subsequently, results of an experiment in which the configuration of the present embodiment was actually applied will be described. In the experiment, the one obtained by attaching the insulating member (part number: E-4382 in Table 1) having a thickness of 1 mm to the conductive member with the adhesive (double stick tape) having a thickness of 0.5 mm was used as the toner adhesion preventing member 620. The results of this experiment are shown as Example 10 in Table 3. In Example 10, the maintenance frequency and the maintenance cost were able to be reduced compared with Conventional Example 1.

The aforementioned respective embodiments can be practiced in appropriate combination. The insulating member can also appropriately be changed in the range of materials that meet the present invention. The particle adhesion preventing member of the present invention can be applied to other apparatuses in addition to the aforementioned image forming apparatuses. For example, the particle adhesion preventing member according to an exemplary embodiment of the present invention can also be used for preventing the adhesion of particles other than the toner. The electric resistance, the shape, the density, the arrangement of the insulating member, the shape and the arrangement of the toner adhesion preventing member, the presence or absence of the adhesive, and the electric resistance of the adhesive can appropriately be changed depending on a purpose of use, an environment of use, a mode of use and the like of the image forming apparatus to be applied. Further, concerning the circumferential velocity and the charging polarity of the photosensitive drum and the intermediate transfer belt, and the presence and absence of the intermediate transfer belt, optical ones can be selected depending on the purpose of use, the environment of use, the mode of use and the like of the image forming apparatus According to an exemplary embodiment of the present invention, the insulating member is charged negatively by adhering the negatively charged particles on the free surface side of the insulating member, and the particles are prevented from further adhering thereto. Thus, the adhesion of the particles can be prevented without providing the device that applies the voltage. As a result, the apparatus incorporating the particle adhesion preventing member can be prevented from increasing in cost and size. Further, the maintenance cost of this apparatus can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-256936 filed Nov. 22, 2012, which is hereby incorporated by reference herein in its entirety.

What is claimed is:

1. An image forming apparatus comprising:

an image bearing member that moves while bearing a toner image;

a developing device that includes a developer bearing member that bears charged toner and develops an electrostatic latent image formed on the image bearing member with toner; and an electric field forming member that forms an electric field between a surface thereof onto which the charged toner adheres and an opposed portion which opposes the electric field forming member in the image forming apparatus, wherein the electric field forming member includes a conductive member connected to ground, and an insulating member attached to the conductive member at a position opposite the opposed portion, the insulating member including a porous member made of an ethylene propylene diene ternary copolymer having a volume resistivity of $10^{10}$ Ω·cm or more and $10^{16}$ Ω·cm or less and a density of 0.01 g/cm$^3$ or more and 0.2 g/cm$^3$ or less, and wherein a normal charge polarity of the toner is in negative polarity and the porous member is negatively charged by being adhered with a negatively-charged toner.

2. The image forming apparatus according to claim 1, wherein the insulating member is attached to the conductive member via an adhesive layer.

3. The image forming apparatus according to claim 1, wherein the insulating member has a coating layer having a higher smoothness than the porous member.

4. The image forming apparatus according to claim 1, wherein a free surface of the insulating member is arranged opposite an image area where the toner image is conveyed by the image bearing member.

5. The image forming apparatus according to claim 1, wherein further comprising:

an intermediate transfer member onto which a toner image formed on the image bearing member is transferred at a transfer position;

a cleaning device configured to clean a residual toner remained on the image bearing member; and a frame body configured to support the image bearing member and the cleaning device, wherein the cleaning device is disposed downstream from the transfer position with respect to a rotating direction of the image bearing member in a state facing the image bearing member, and the electric field forming member is attached to the frame body downstream from the transfer position with respect to a rotating direction of the image bearing member and closely opposing a surface of the intermediate transfer member.

6. The image forming apparatus according to claim 5, wherein, with respect to a width direction of the intermediate transfer member, the electric field forming member is longer than a width of an image formed on the intermediate transfer member.

7. The image forming apparatus according to claim 5, further comprising:

a first side plate configured to support one end of the image bearing member; and a second side plate configured to support the other end of the image bearing member, wherein the conductive member is a coupling member configured to couple the first side and the second side plate.

8. The image forming apparatus according to claim 1, wherein a charging polarity of the porous member is in more negative polarity than the charging polarity of the toner.

9. An electric field forming member used for an image forming apparatus that forms an image using charged toner, and configured to form an electric field between a surface thereof onto which the charged toner adheres and an opposed portion which opposes the electric field forming member in the image forming apparatus, the electric field forming member comprising:

a conductive member connected to ground; and an insulating member attached to the conductive member at a position opposite the opposed portion, the insulating member including a porous member made of an ethylene propylene diene ternary copolymer having a volume resistivity of $10^{10}$ Ω·cm or more and $10^{16}$ Ω·cm or less and a density of 0.01 g/cm$^3$ or more and 0.2 g/cm$^3$ or less, and wherein a normal charge polarity of the toner is in negative polarity and the porous member is negatively charged by being adhered with a negatively-charged toner.

10. The electric field forming member according to claim 9, wherein the insulating member is attached to the conductive member via an adhesive layer.

11. The electric field forming member according to claim 9, wherein the insulating member has a coating layer having a higher smoothness than the porous member.

12. The electric field forming member according to claim 9, wherein the image forming apparatus includes an image bearing member that moves while bearing a toner image, and wherein a free surface of the insulating member is arranged opposite the image bearing member.

13. The electric field forming member according to claim 9, wherein the electric field forming member is arranged at a position such that a distance between a free surface of the insulating member and the opposed portion is 1 mm or more and 10 mm or less.

14. The electric field forming member according to claim 6, wherein the image forming apparatus includes an image bearing member that moves while bearing a toner image and a developing device that includes a toner bearing member that bears toner and develops an electrostatic latent image formed on the image bearing member with toner, and wherein the electric field forming member is arranged opposite the toner bearing member.

15. The electric field forming member according to claim 9, wherein the porous member is in more negative polarity than the charging polarity of the toner.

16. An image forming apparatus comprising:

an image bearing member that moves while bearing a toner image;

a developing device that includes a developer bearing member that bears charged toner and develops an electrostatic latent image formed on the image bearing member with toner; and an electric field forming member that forms an electric field between a surface thereof onto which the charged toner adheres and an opposed portion which opposes the electric field forming member in the image forming apparatus, wherein the electric field forming member includes a conductive member provided to maintain a predetermined reference potential, and an insulating member attached to the conductive member at a position opposite the opposed portion, the insulating member including a porous member made of silicon having a volume resistivity of $10^{10}$ Ω·cm or more and $10^{16}$ Ω·cm or less and a density of 0.01 g/cm$^3$ or more and 0.3 g/cm$^3$ or less, and wherein a normal charge polarity of the toner is in negative polarity and the porous member is negatively charged by being adhered with a negatively-charged toner.

17. The image forming apparatus according to claim 16, wherein the insulating member is attached to the conductive member via an adhesive layer.

18. The image forming apparatus according to claim 16, wherein the insulating member has a coating layer having a higher smoothness than the porous member.

19. The image forming apparatus according to claim 16, wherein a free surface of the insulating member is arranged opposite an image area where the toner image is conveyed by the image bearing member.

20. The image forming apparatus according to claim 16, wherein the conductive member is connected to ground.

21. The image forming apparatus according to claim 16, wherein the porous member is in more negative polarity than the charging polarity of the toner.

22. An electric field forming member used for an image forming apparatus that forms an image using charged toner, and configured to form an electric field between a surface thereof onto which the charged toner adheres and an opposed portion which opposes the electric field forming member in the image forming apparatus, the electric field forming member comprising:

a conductive member provided to maintain a predetermined reference potential; and an insulating member attached to the conductive member at a position opposite the opposed portion, the insulating member including a porous member made of silicon having a volume resistivity of $10^{10}$ Ω·cm or more and $10^{16}$ Ω·cm or less and a density of 0.01 g/cm$^3$ or more and 0.3 g/cm$^3$ or less, and wherein a normal charge polarity of the toner is in negative polarity and the porous member is negatively charged by being adhered with a negatively-charged toner.

23. The electric field forming member according to claim 22, wherein the insulating member is attached to the conductive member via an adhesive layer.

24. The electric field forming member according to claim 22, wherein the insulating member has a coating layer having a higher smoothness than the porous member.

25. The electric field forming member according to claim 22, wherein the image forming apparatus includes an image bearing member that moves while bearing a toner image, and wherein a free surface of the insulating member is arranged opposite the image bearing member.

26. The electric field forming member according to claim 22, wherein the electric field forming member is arranged at a position such that a distance between a free surface of the insulating member and the opposed portion is 1 mm or more and 10 mm or less.

27. The electric field forming member according to claim 22, wherein the image forming apparatus includes an image bearing member that moves while bearing a toner image and a developing device that includes a toner bearing member that bears toner and develops an electrostatic latent image formed on the image bearing member with toner, and wherein the electric field forming member is arranged opposite the toner bearing member.

28. The electric field forming member according to claim 22, wherein the conductive member is connected to ground.

29. The image forming apparatus according to claim 22, further comprising:

an intermediate transfer member onto which a toner image formed on the image bearing member is transferred at a transfer position;

a cleaning device configured to clean a residual toner remained on the image bearing member; and a frame body configured to support the image bearing member and the cleaning device, wherein the cleaning device is disposed downstream from the transfer position with respect to a rotating direction of the image bearing member in a state facing the image bearing member, and the electric field forming member is attached to the frame body downstream from the transfer position with respect to a rotating direction of the image bearing member and closely opposing a surface of the intermediate transfer member.

30. The image forming apparatus according to claim 29, wherein, with respect to a width direction of the intermediate transfer member, the electric field forming member is longer than a width of an image formed on the intermediate transfer member.

31. The image forming apparatus according to claim 29, further comprising:

a first side plate configured to support one end of the image bearing member; and a second side plate configured to support the other end of the image bearing member, wherein the conductive member is a coupling member configured to couple the first side and the second side plate.

32. The electric field forming member according to claim 22, wherein the porous member is in more negative polarity than the charging polarity of the toner.

33. A developing device comprising:

a developer bearing member configured to bear a developer including a toner and a carrier;

a developing container rotatably supporting the developer bearing member, configured to contain a developer supplied to the developer bearing member;

an electric field forming member provided to the developing container so as to oppose to the developer bearing member, configured to form an electric field between a surface thereof onto which a charged toner adheres, a conductive member; and an insulating member attached to the conductive member at a position opposite the opposed portion, the insulating member including a porous member made of an ethylene propylene diene ternary copolymer having a volume resistivity of $10^{10}$ Ω·cm or more and $10^{16}$ Ω·cm or less and a density of 0.01 g/cm$^3$ or more and 0.2 g/cm$^3$ or less, and wherein a normal charge polarity of the toner is in negative polarity and the porous member is negatively charged by being adhered with a negatively-charged toner.

34. The developing device according to claim 33, wherein the conductive member is connected to ground.

35. The developing device according to claim 33, wherein the porous member is in more negative polarity than the charging polarity of the toner.

36. A developing device comprising:

a developer bearing member configured to bear a developer including a toner and a carrier;

a developing container rotatably supporting the developer bearing member, configured to contain a developer supplied to the developer bearing member;

an electric field for forming member provided to the developing container so as to oppose to the developer bearing member, configured to form an electric field between a surface thereof onto which a charged toner adheres, wherein the electric field forming member comprising:

a conductive member; and an insulating member attached to the conductive member at a position opposite the opposed portion, the insulating member including a porous member made of silicon having a volume resistivity of $10^{10}$ Ω·cm or more and $10^{16}$ Ω·cm or less and a density of 0.01 g/cm$^3$ or more and 0.3 g/cm$^3$ or less, wherein a normal charge polarity of the toner is in negative polarity and the porous member is negatively charged by being adhered with a negatively-charged toner.

37. The developing device according to claim 36, wherein the conductive member is connected to ground.

38. The developing device according to claim 36, wherein the porous member is in more negative polarity than the charging polarity at the toner.

* * * * *